US008018480B2

(12) United States Patent
Yamazaki

(10) Patent No.: US 8,018,480 B2
(45) Date of Patent: Sep. 13, 2011

(54) IMAGE FORMING APPARATUS AND ITS CONTROL METHOD

(75) Inventor: Katsuyuki Yamazaki, Toride (JP)

(73) Assignee: Canon Kabushiki Kaisha (JP)

( * ) Notice: Subject to any disclaimer, the term of this patent is extended or adjusted under 35 U.S.C. 154(b) by 235 days.

(21) Appl. No.: 12/273,677

(22) Filed: Nov. 19, 2008

(65) Prior Publication Data

US 2009/0135243 A1 May 28, 2009

(30) Foreign Application Priority Data

Nov. 22, 2007 (JP) ..... 2007-303538

(51) Int. Cl.
*B41J 2/47* (2006.01)

(52) U.S. Cl. ..... 347/254

(58) Field of Classification Search ..... 347/232–234, 347/240, 248, 251–254
See application file for complete search history.

(56) References Cited

U.S. PATENT DOCUMENTS

| | | | | |
|---|---|---|---|---|
| 6,631,207 | B2 * | 10/2003 | Hirota et al. | 382/167 |
| 7,110,016 | B2 | 9/2006 | Suzuki et al. | |
| 7,630,100 | B2 * | 12/2009 | Tojima et al. | 358/3.26 |
| 2006/0226338 | A1 | 10/2006 | Tojima et al. | |

FOREIGN PATENT DOCUMENTS

| | | | |
|---|---|---|---|
| JP | 2-50176 | A | 2/1990 |
| JP | 2003-182146 | A | 7/2003 |
| JP | 2003-276235 | A | 9/2003 |
| JP | 2003-322811 | A | 11/2003 |
| JP | 2006-289749 | A | 10/2006 |

* cited by examiner

*Primary Examiner* — Hai C Pham
(74) *Attorney, Agent, or Firm* — Rossi, Kimms & McDowell LLP

(57) ABSTRACT

A first process unit replaces a portion of pixels in a pixel sequence forming a first scanning line of a first color by a different portion of pixels in a pixel sequence forming a second scanning line of the first color. A second process unit performs a thicken process to a pixel sequence of a scanning line of a second color superimposed on the first line of the first color to thicken the pixel sequence of the scanning line of the second color. The pixel sequence of the scanning line to be thickened corresponds a replacement point of the replaced pixel of the first color.

7 Claims, 17 Drawing Sheets

IMAGE FORMING APPARATUS AND ITS CONTROL METHOD

BACKGROUND OF THE INVENTION

1. Field of the Invention

The present invention relates to an image forming apparatus, and more particularly, to a technique of correcting a curvature of a scanning line in an image forming apparatus for forming an image using a light beam.

2. Description of the Related Art

Conventionally, there is a need for higher image quality, higher speed and higher performance for an image forming apparatus. Particularly, in a laser-scanning image forming apparatus, high-cost parts with high geometric accuracy (a lens, a supporting member, a rotational polygonal member and the like for laser scanning) have been employed so as to maintain a high level of accuracy of an image formation position.

On the other hand, there is also a need for a further reduction in cost of the whole apparatus. To achieve this, it is desirable to reduce the high-cost parts with high geometric accuracy to the extent possible. Therefore, it is necessary to use a digital correction technique, such as, representatively, image processing or laser PWM, to reduce required geometric accuracy, thereby reducing the cost of the apparatus.

Incidentally, a problem with a color printer or the like is how to correct a curvature of a scanning line of a laser. In a typical color printer including a rotational polygonal mirror, an fθ lens and a mirror, a curvature of a scanning line occurs particularly due to a manufacturing error or an attachment error from an optical path of the fθ lens. On the other hand, an inclination of a scanning line occurs due to an inclination of the mirror or an inclination of image carrier.

The curvature or inclination of a scanning line may be corrected by a mechanical method or an image processing method. In the mechanical method, the curvature or inclination of a scanning line is corrected by moving optical parts or the like. However, this method requires additional mechanical parts for moving the optical parts, which is contrary to the need for a reduction in cost of the apparatus.

In the image processing method, the curvature or inclination of a scanning line is corrected by shifting a digital image composed of a plurality of pixels two-dimensionally arranged, in a sub-scanning direction in accordance with curvature points (Japanese Patent Laid-Open Nos. 02-50176, 2003-276235 and 2003-182146). Specifically, it has been proposed that images of a portion of pixels constituting one line are not formed by a corresponding scanning line, but are formed by a scanning line adjacent thereto. A portion of pixels in a pixel sequence forming a first scanning line is replaced by a different portion of pixels in a pixel sequence forming a second scanning line where the different portion of pixels is adjacent to the portion of pixels to be replaced. In other words, replacement of a scanning line is performed. Hereinafter, a deviation and a distortion from an ideal position of a scanning line as well as an inclination of a scanning line are referred to as a curvature.

FIG. 9 shows states before and after correction of a curved scanning line. As can be seen from FIG. 9, a deviation or a distortion from an ideal position can be reduced by correction. However, a bump of one scanning line occurs in a portion to which correction has been applied. The bump can be visually recognized, depending on the image data, resulting in a deterioration in an image.

An image density calculation process (hereinafter referred to as a blend process) may be performed so as to cause the one-scanning line bump to be difficult to see. The blend process is a process of distributing image data corresponding to one scanning line over two scanning lines, thereby causing a bump occurring at a replacement point to be difficult to visually recognize.

However, a color printer that forms an image by superimposition of YMCK may have a problem with such a simple blend process when "horizontal line data having a one-scanning line width of a secondary color obtained by superimposing Y and M" is drawn. Note that Y, M, C and K are abbreviations of yellow, magenta, cyan and black, respectively.

It is assumed that curvature correction in the sub-scanning direction is applied only to the Y color. Specifically, it is assumed that the blend process has been performed with respect to the Y color in two scanning lines adjacent to each other in the sub-scanning direction. In this case, a scanning line of the Y color and a scanning line of the M color that is superimposed thereon have a difference in laser scanning line width (laser spot diameter) corresponding to the ratio of 2 to 1, resulting in a significant color deviation between the Y color and the M color. In particular, a bump caused by correction can be visually recognized in thin line data or character data of a secondary color that have a high contrast. The bump may be significant when the resolution is 600 dpi or less, depending on the accuracy of pixel formation.

SUMMARY OF THE INVENTION

Therefore, a feature of the present invention is to solve at least one of these problems and other problems. For example, a feature of the present invention is to correct a curvature of a scanning line and, meanwhile, causing a color deviation to be difficult to visually recognize, using a relatively low-cost configuration, even in a multicolor image forming apparatus. Note that other problems will be herein understood.

The technical idea of the present invention is applied to, for example, an image forming apparatus for forming multicolor image by superimposing a plurality of different colors on each other. A replacement process unit (first process unit) replaces a portion of pixels in a pixel sequence forming a first scanning line of a first color is replaced by a different portion of pixels in a pixel sequence forming a second scanning line of the first color to correct a curvature of the first scanning line of the first color where the different portion of pixels are adjacent to the portion of pixels to be replaced. A portion of pixels of a line of interest in image data is replaced to a different portion of pixels in an adjacent line. The replacement point refers to a boundary between a pixel that is replaced from the line of interest to the adjacent line, and a pixel that is not been replaced. A changing unit (second process unit) changes data of pixels closely located at the replacement point to thicken a line of a second color closely located at the replacement point. The line of a second color is superimposed on the line of the first color. Regarding a pixel sequence forming a scanning line of the second color superimposed on the first scanning line of the first color, a line of a pixel sequence of the second color corresponding to the replacement point of pixels of the first color.

Further features of the present invention will become apparent from the following description of exemplary embodiments (with reference to the attached drawings).

DESCRIPTION OF THE EMBODIMENTS

An embodiment of the present invention will be hereinafter described. Each individual embodiment described below will help understanding of various concepts, such as a broader concept, an intermediate concept, a narrower concept and the like, of the present invention. Also, the technical scope of the present invention is determined based on the scope of the claims and is not limited by each individual embodiment described below.

First Embodiment

Configuration of Image Forming Apparatus

Figure 1:
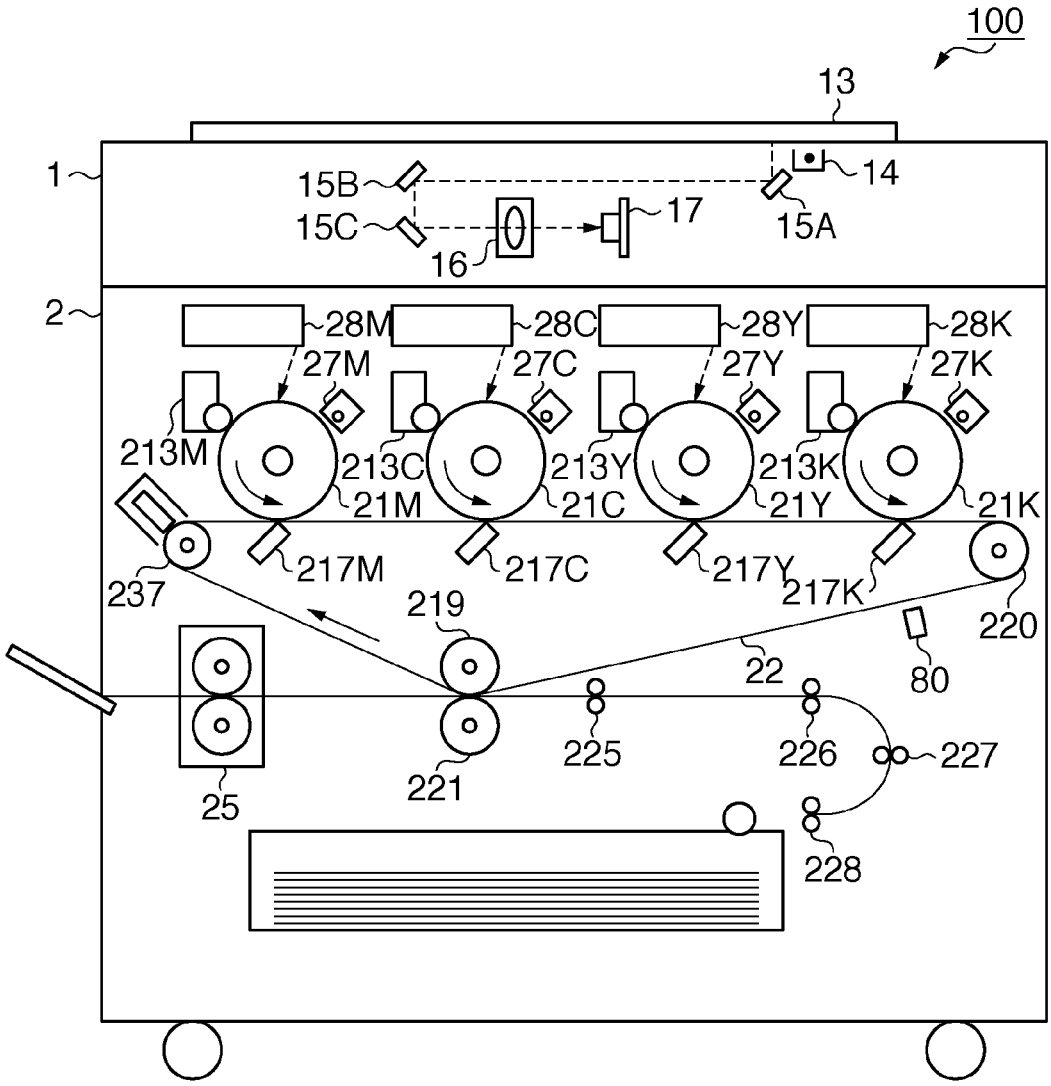
FIG. 1 is a cross-sectional view schematically showing an image forming apparatus according to an example for superimposing a plurality of colors on each other to form a multicolor image.

FIG. 1 is a cross-sectional view schematically showing an image forming apparatus according to an example for superimposing a plurality of colors on each other to form a multicolor image. This image forming apparatus indicates a four-drum color copier in which four photosensitive members are arranged in tandem. Note that the image forming apparatus may be implemented as a printing apparatus, a printer, a compound machine or a fax machine, for example. When the present invention is applied, the number of colors may be at least two. Therefore, the number of photosensitive members may be two or more. Hereinafter, outlines of a color image reading apparatus (hereinafter referred to as a "color scanner") 1 and a color image recording apparatus (hereinafter referred to as a "color printer") 2 included in the color copier 100 will be described.

The color scanner 1 forms an image of an original 13 via an illumination lamp 14, mirrors 15A, 15B and 15C, and a lens 16 on a CCD sensor 17 that is a color sensor. Further, the color scanner 1 reads color image information of an original for each color-separated light (e.g., blue (hereinafter referred to as B), green (hereinafter referred to as G), and red (hereinafter referred to as R)), and converts it into an electrical image signal.

The color scanner 1 performs a color converting process based on intensity levels of image signals of B, G and R. Thereby, pieces of color image data of black (K), cyan (C), magenta (M) and yellow (Y) are obtained.

Next, the color printer 2 will be described. Optical write units 28M (for magenta), 28Y (for yellow), 28C (for cyan) and 28K (for black) are provided for respective corresponding color toners (one optical write unit for each color toner). Note that suffixes (M, Y, C and K) added to reference numerals indicate toner colors. The suffixes M, Y, C and K are omitted when common matter is described. These optical write units 28 are exemplary scanning units for scanning respective corresponding image carriers using respective corresponding beams modulated with pixel data read out from an accumulation unit, for respective corresponding colors. The optical write unit is also called an exposure apparatus or a scanner apparatus.

The optical write units convert color image data from the color scanner 1 into optical signals and perform optical writing. Thereby, electrostatic latent images are formed on photosensitive members 21M, 21Y, 21C and 21K provided for respective colors. These photosensitive members are exemplary image carriers.

The photosensitive members 21M, 21Y, 21C and 21K are rotated counterclockwise as indicated by arrows. Chargers 27M, 27Y, 27C and 27K for uniformly charging the respective corresponding photosensitive members are provided near the respective corresponding photosensitive members. Also, an M development unit 213M, a C development unit 213C, a Y development unit 213Y and a Bk development unit 213K for developing electrostatic latent images using developers (e.g., toners) are provided. Also, an intermediate transfer belt 22 as an intermediate transfer member is stretched and supported by a drive roller 220 and idler rollers 219 and 237. Note that first transfer bias blades 217M, 217Y, 217C and 217K as first transfer units are provided, facing the respective corresponding photosensitive members.

A second transfer bias roller 221 is provided, facing the idler roller 219. The second transfer bias roller 221 is allowed to be separated from or contact the intermediate transfer belt 22 using a separation/contacting mechanism (not shown).

In the color printer 2, image formation is started initially from magenta. Thereafter, image formation of cyan is started at a timing delayed by a time corresponding a distance between the photosensitive member 21M and the photosensitive member 21C with respect to the rotational speed of the intermediate transfer belt 22. Next, image formation of yellow is started at a timing delayed by a time corresponding to a distance between the photosensitive member 21C and the photosensitive member 21Y with respect to the rotational speed of the intermediate transfer belt 22. Finally, image formation of black is started at a timing delayed by a time corresponding to a distance between photosensitive member 21Y and the photosensitive member 21K with respect to the rotational speed of the intermediate transfer belt 22. Thus, a multicolor image obtained by superimposing developer images of the colors on each other is formed on the intermediate transfer belt 22. The multicolor image is transferred to a printing material that is transported by the transfer rollers 228, 227, 226 and 225 at a secondary transfer position formed by the idler roller 219 and the second transfer bias roller 221. Thereafter, the color image is fixed on a surface of the printing material by a fixing apparatus 25. Note that the printing material may also be called a printing medium, paper, a sheet, a transfer material or transfer paper, for example.

A patch detecting sensor 80 is provided near the intermediate transfer belt 22. The patch detecting sensor 80 is a sensor for detecting a patch that is used so as to detect a color deviation or the like.

Figure 2:
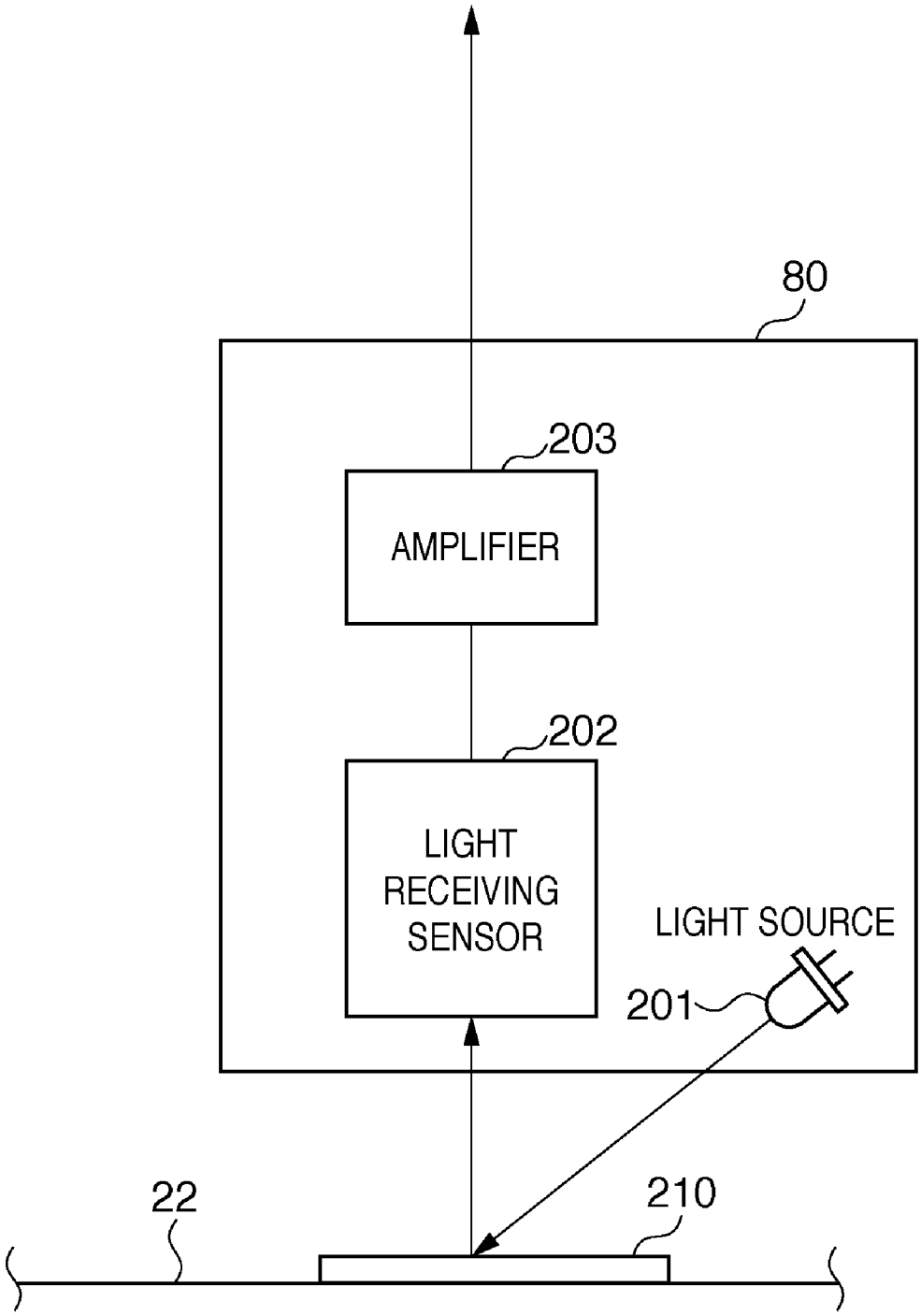
FIG. 2 is a diagram showing an exemplary patch detecting sensor.

FIG. 2 is a diagram showing an exemplary patch detecting sensor. The patch detecting sensor 80 comprises, for example, a light source 201 for outputting light, a light receiving sensor 202 for receiving light reflected from a patch 210 formed on the intermediate transfer belt 22, and an amplifier 203 for amplifying a signal from the light receiving sensor 202.

<Configuration of Control Unit>

Figure 3:
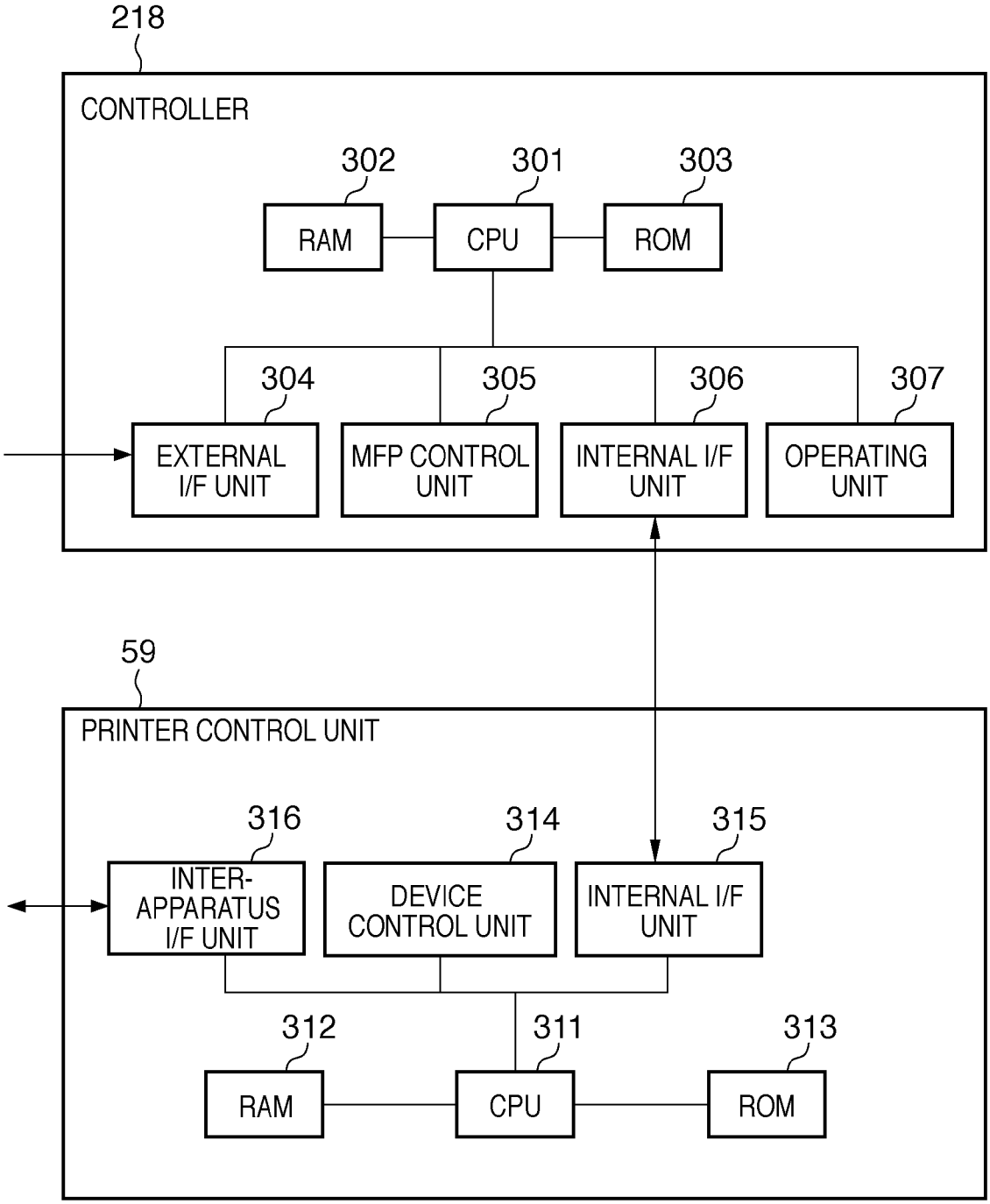
FIG. 3 is a block diagram showing a control unit according to an embodiment of the present invention.

FIG. 3 is a block diagram showing a control unit according to this embodiment. A ROM 303 that stores a control program and a RAM 302 that stores data for a process are connected via an address bus and a data bus to a CPU 301 of a controller unit 218. Also, an external I/F unit 304, an MFP control unit 305, an internal I/F unit 306, and an operating unit 307 are connected to the CPU 301.

The external I/F unit 304 is a communication unit for communicating with the outside. The MFP control unit 305 performs a process, accumulation, and image processing with respect to scanned image data of the original 13 or PDL data from the external I/F unit 304. The internal I/F unit 306 is a communication unit for communicating with a printer control unit 59. The operating unit 307 includes a display apparatus and an input apparatus.

The printer control unit 59 includes a CPU 311 for performing a basic control of an image formation operation. A ROM 313 that stores a control program and a RAM 312 that stores data for performing a process of the image formation operation are connected via an address bus and a data bus to the CPU 311. It is assumed that the ROM 313 stores a control procedure described below and the like. A device control unit 314 is an electrical circuit including, for example, an I/O port for controlling parts of the color printer 2. An internal I/F unit 315 is a communication unit for transmitting and receiving an image signal or a timing signal to and from the controller unit 218. An inter-apparatus I/F unit 316 is a communication unit for transmitting and receiving sheet information or timing information to and from a sheet processing apparatus (not shown). For example, the CPU 311 receives an image signal via the internal I/F unit 315 from the controller unit 218 and controls the device control unit 314 to execute the image formation operation, in accordance with a control program.

<Configuration of MFP Control Unit>

Figure 4:
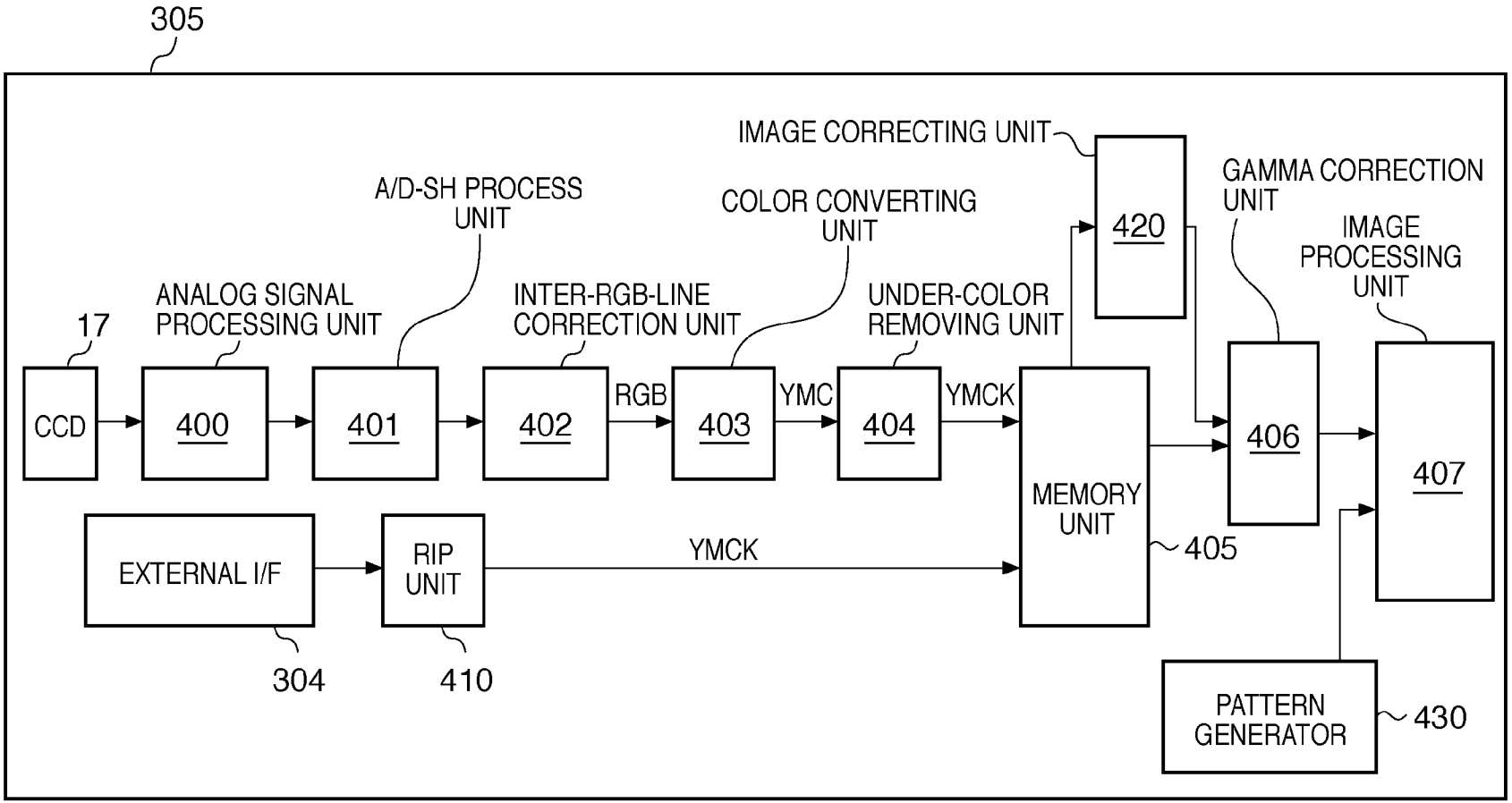
FIG. 4 is a block diagram showing an exemplary MFP control unit.

FIG. 4 is a block diagram showing an exemplary MFP control unit. Examples of image data input to the MFP control unit 305 include image data output from the CCD sensor 17 of the color scanner 1, and image data received via the external I/F unit 304 from a host computer or the like.

An original image formed on the CCD sensor 17 is converted into an analog electrical signal by the CCD sensor 17. An analog signal processing unit 400 corrects a dark level of converted image information, for example. Next, an A/D·SH process unit 401 performs analog-to-digital conversion (A/D conversion) with respect to image information, and performs shading correction with respect to the resultant digital signal. By the shading correction, variations between each pixel possessed by the CCD sensor 17, or variations in amount of light due to the light distribution characteristics of an original illumination lamp, are corrected.

An inter-RGB-line correction unit 402 performs inter-RGB-line correction with respect to the shading-corrected signal. Light that is input to R, G and B light receiving units of the CCD sensor 17 at certain time, is deviated on an original, depending on a positional relationship of the R, G and B light receiving units. Therefore, R, G and B signals are here synchronized with each other. Thereafter, a color converting unit 403 converts the R, G and B signals into Y, M and C signals by direct mapping. Next, an under-color removing unit 404 generates a K signal form the Y, M and C signals. In this case, the smallest value of the densities of the Y, M and C signals is subtracted as a gray component to obtain density signals Dy, Dm and Dc. Gain adjustment is then performed with respect to the gray component to obtain a density signal Dk of K. The resultant density signals are stored into a memory unit 405.

On the other hand, an RIP unit 410 analyzes PDL data received from the external I/F unit 304, converts the PDL data into data in a standardized L*a*b* space, and converts the L*a*b* data back into data in a YMCK space suitable for a target printer. Further, the RIP unit 410 generates and stores Y, M, C and K signals into the memory unit 405.

An image correcting unit 420 corrects the density of image data stored in the memory unit 405 with reference to the density of a patch detected by the patch detecting sensor 80.

Image data for which correction is not required is directly input from the memory unit 405 to a gamma correction unit 406.

The gamma correction unit 406 generates an image density signal so that an image density during initial setting of the color printer 2 is equal to an output density image processed in accordance with γ characteristics, for each of Y, M, C and K, using a corresponding look-up table. An image processing unit 407 performs pulse-width modulation with respect to the image density signals, and outputs the resultant image density signals to laser drivers of the optical write units 28M to 28K, respectively. A pattern generator 430 generates a pattern (image data) of the patch.

<Laser Scanning for Formation of Latent Image>

Figure 5:
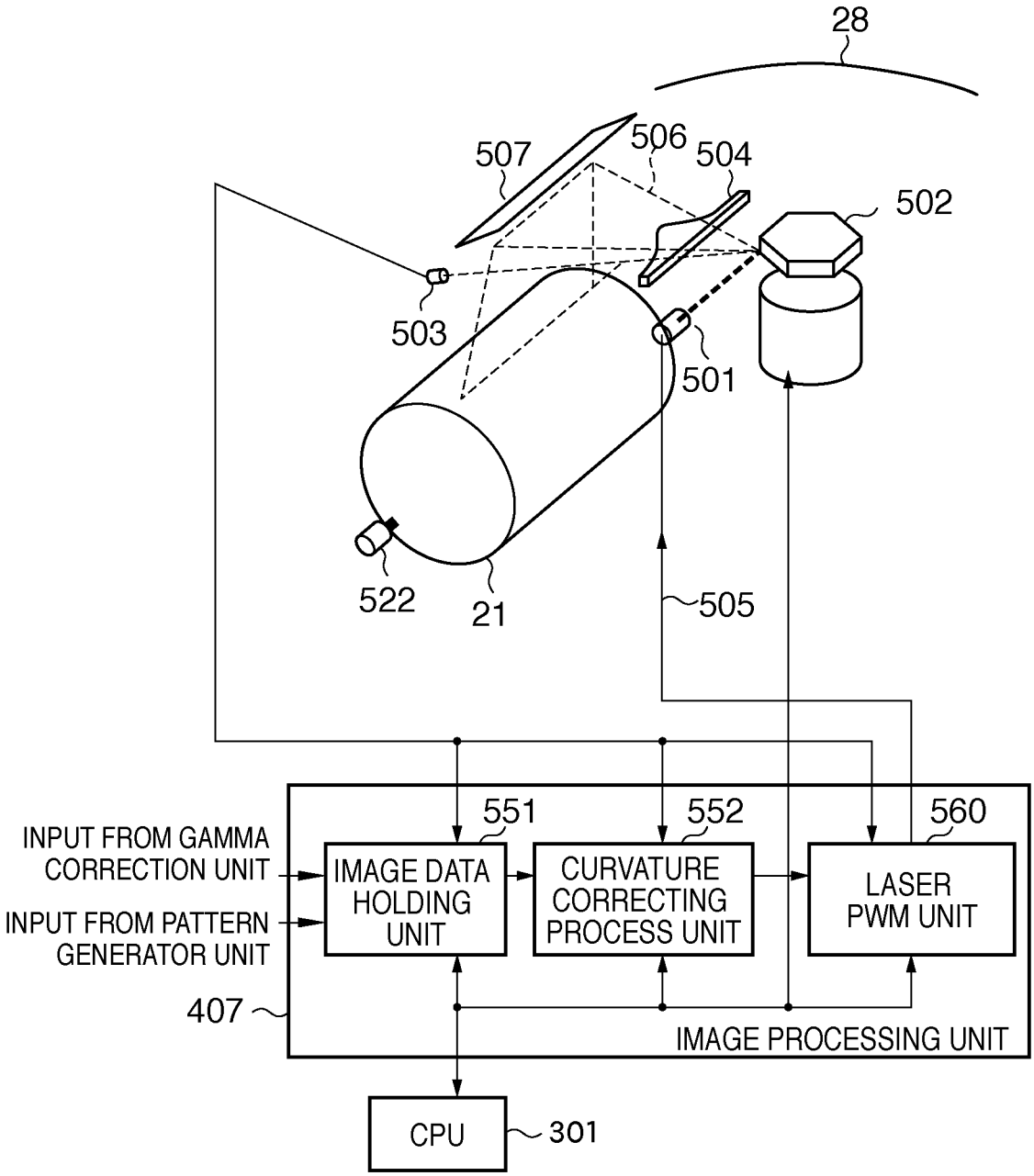
FIG. 5 is a diagram for describing an example of an image processing unit and formation of an electrostatic latent image.

FIG. 5 is a diagram for describing an example of the image processing unit 407 and formation of an electrostatic latent image. A semiconductor laser device 501 is an exemplary light source for outputting a light beam. A polygon mirror and its driving apparatus 502 are a rotational polygonal mirror that deflects a light beam while rotating and its driving motor, for example. A main scanning write position sensor 503 is a photosensor that is utilized to recognize a start timing of laser scanning. An fθ lens 504 is an optical part for performing conversion so as to allow a deflection-scanned light beam to move on a photosensitive member with constant velocity. A signal line 505 is a signal line for supplying a drive signal to the semiconductor laser device 501. A laser optical path 506 is an optical path on which a deflection-scanned light beam is passed. A mirror 507 is a mirror for converting a direction of the laser optical path 506 from a horizontal direction to a downward direction. These parts constitute the optical write unit 28. A photosensitive member driving apparatus 522 is a motor for driving the photosensitive member 21, for example.

An image data holding unit 551 is a buffer memory for selectively holding image data received from the gamma correction unit 406 or the pattern generator 430, for example. A curvature correcting process unit 552 is a data processing unit for executing a calculation for performing curvature correction with respect to image data received from the image data holding unit 551. The curvature correcting process unit 552 is an exemplary replacement process unit for replacing a portion of pixels of a line of interest in image data to pixels of an adjacent line so as to correct a curvature of a scanning line of a first color. The curvature correcting process unit 552 is also an exemplary reduction process unit for adjusting the densities of a plurality of pixels existing near a pixel replacement point, thereby reducing a bump occurring at the replacement point. The replacement point refers to a boundary between a pixel that has been replaced from the line of interest to the adjacent line, and a pixel that has not been replaced. Further, the curvature correcting process unit 552 is an exemplary changing unit for changing data of a pixel near a replacement point so as to increase a width near the replacement point of a line of a second color that is formed and superimposed on a line of a first color. A laser PWM unit 560 converts the density of image data received from the curvature correcting process unit 552 into a laser emission time. As the density increases, the emission time increases. In other words, as the density decreases, the emission time decreases. It is well known that the spot diameter of a light beam in the photosensitive member 21 is determined, depending on the length of the emission time.

Note that the image processing unit 407 and the optical write unit 28 function and operate in association with each other in accordance with an instruction of the CPU 301. The image processing unit 407 receives various forms of image data, generates a drive signal, and transmits it to the optical write unit 28. The optical write unit 28, when receiving it, scans the photosensitive member 21 using a light beam to form an electrostatic latent image.

<Detection of Color Deviation>

Figure 6A:
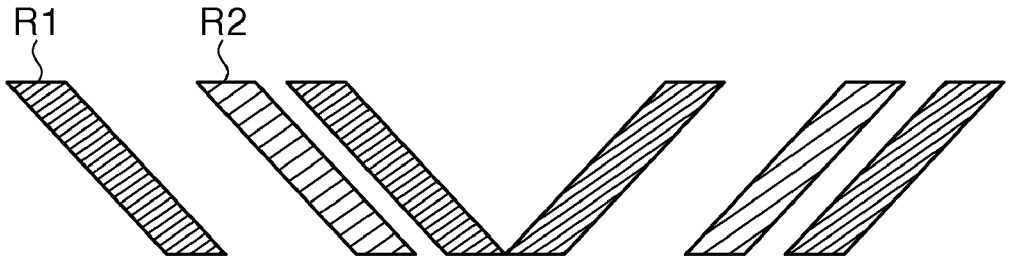
FIG. 6A is a diagram showing an exemplary patch for detecting a color deviation.

FIG. 6A is a diagram showing an exemplary patch for detecting a color deviation. Image data of the patch for detecting a color deviation is also generated by the pattern generator 430. As shown in FIG. 6A, the patch includes a pattern R1 of yellow Y (reference color) and a pattern R2 of another color (magenta M in FIG. 6A). The CPU 301 can measure the amount of a deviation with respect to the reference color by measuring a distance between the patterns R1 and R2 using the patch detecting sensor 80.

Figure 6B:
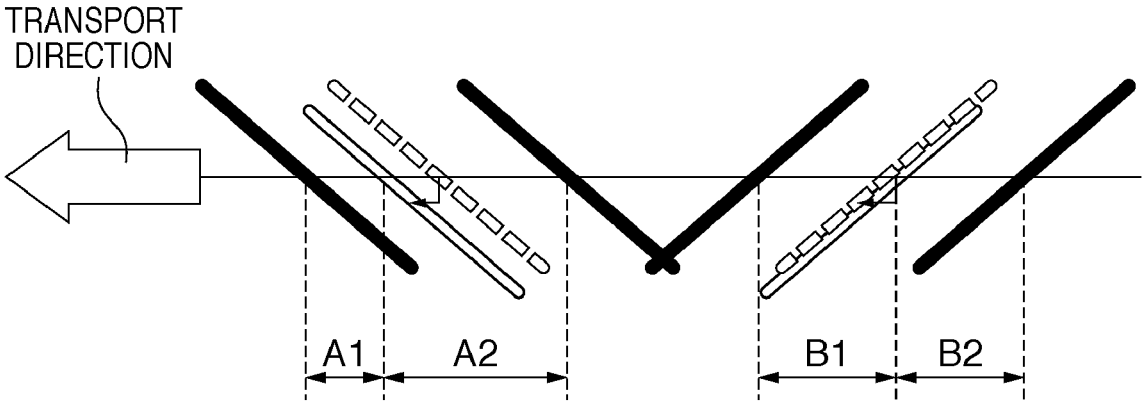
FIG. 6B is a diagram for describing an exemplary method for calculating the amount of a deviation with respect to a Y color that is a reference color.

FIG. 6B is a diagram for describing an exemplary method for calculating the amount of a deviation with respect to the Y color that is a reference color. As shown in FIG. 6B, the patch detecting sensor 80 reads a formed resist pattern to detect distances A1, A2, B1 and B2. A deviation amount ΔH in the main scanning direction and a deviation amount ΔV in the sub-scanning direction with respect to the Y color are represented by expressions below.

$$\Delta H=\{(B2-B1)/2-(A2-A1)/2\}/2$$

$$\Delta V=\{(B2-B1)/2+(A2-A1)/2\}/2$$

In this embodiment, every time one hundred pages or more are cumulatively formed, a patch is formed, and the deviation amount ΔH in the main scanning direction and the deviation amount ΔV in the sub-scanning direction are calculated.

<Correction of Image Formation Position Using Patch for Detection of Color Deviation>

If a color deviation is detected, a color deviation correcting process is executed. Specifically, a drawing timing delay amount corresponding to a space between a photosensitive member of a reference color and a photosensitive member of a color to be corrected and a drawing timing delay amount with respect to an output timing of a detection signal from the main scanning write position sensor 503, are corrected so as to eliminate a color deviation.

Figure 7:
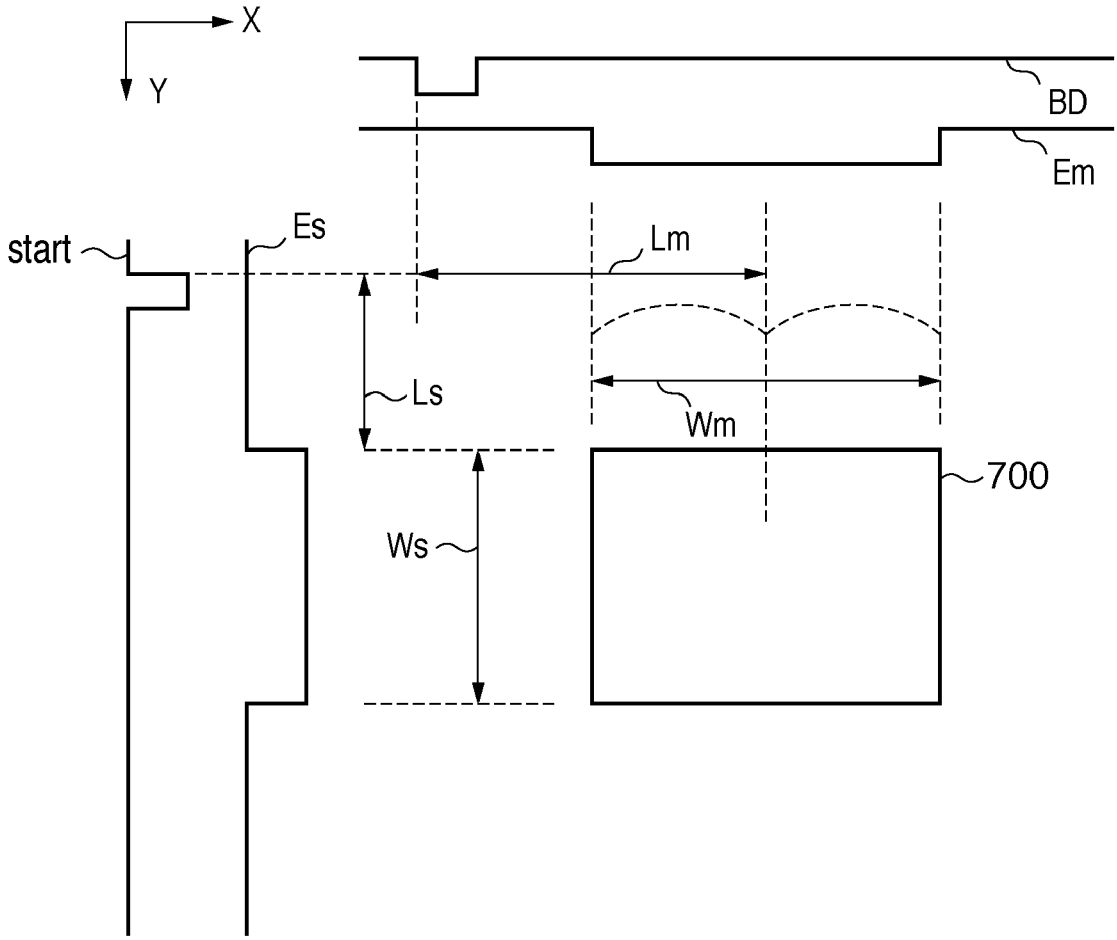
FIG. 7 is a diagram showing a relationship between a print page area and each signal.

FIG. 7 is a diagram showing a relationship between a print page area and each signal. In FIG. 7, the main scanning direction is represented by the X axis, and the sub-scanning direction is represented by the Y axis. The print page area 700 is in the shape of a rectangle having a main scanning width Wm and a sub-scanning width Ws. A detection signal of the main scanning write position sensor 503 is indicated by "BD". A drawing starting position signal is indicated by "start". A signal indicating an effective image area in the main scanning direction is indicated by "Em". A signal indicating an effective image area in the sub-scanning direction is indicated by "Es". A distance (delay time) from a rising position of the BD signal to a drawing position reference in the main scanning direction is indicated by "Lm". A distance (delay time) from a rising position of the start signal to a drawing position reference in the sub-scanning direction is indicated by "Ls". For example, a deviation amount in the main scanning direction is reflected on Lm. Note that Ls varies among the Y, M, C and K colors as described below.

Figure 8:
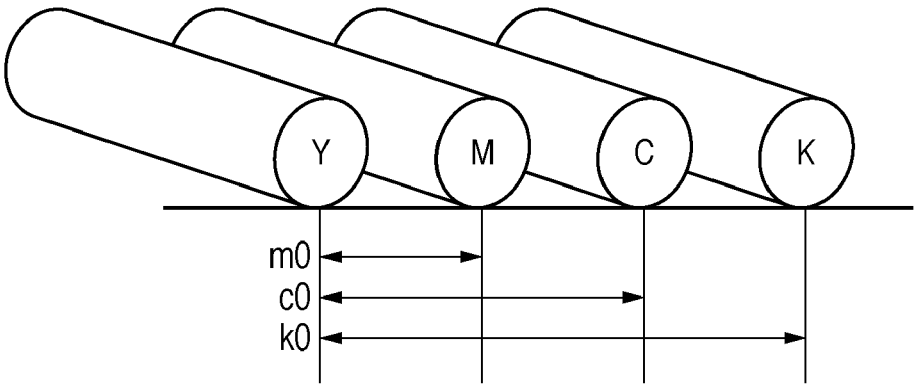
FIG. 8 is a diagram showing a relationship between photosensitive members of Y, M, C and K colors and an intermediate transfer belt.

FIG. 8 is a diagram showing a relationship between the photosensitive members 21 of the Y, M, C and K colors and the intermediate transfer belt 22. Ls of each of M, C and K corresponds to a time obtained by dividing a corresponding distance m0, c0 or k0 in FIG. 8 by the circumferential velocity of the intermediate transfer belt 22. In FIG. 8, a drawing starting position signal of each color is output when a corresponding delay time has passed with reference to a drawing timing of the Y color. A deviation amount in the sub-scanning direction is reflected on Ls. The drawing starting position signal (start) is issued by the device control unit 314 in accordance with an instruction of the CPU 311.

<Curvature Correction in Sub-scanning Direction during Formation of Latent Image>

Figure 9:
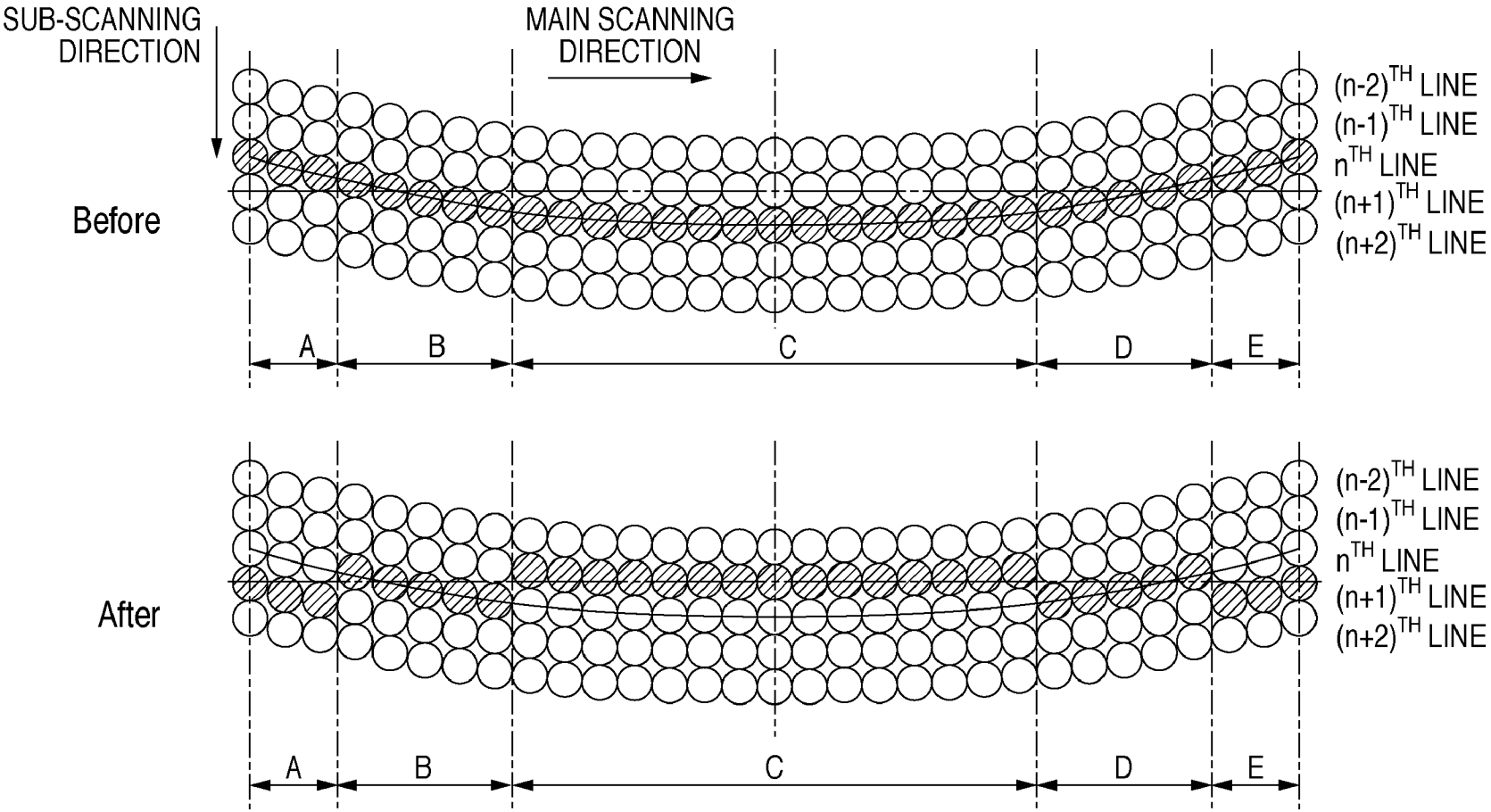
FIG. 9 is a diagram showing an example in which a scanning line is curved in a sub-scanning direction and an example in which the curvature is corrected.

FIG. 9 is a diagram showing an example in which a scanning line is curved in the sub-scanning direction, and an example in which the curvature is corrected. In particular, the upper portion of FIG. 9 shows a relationship between five adjacent scanning line paths and pixels when curvature correction has not been performed. Each of circles indicating a scanning line indicates a drawing position of a pixel. Note that shaded circles indicate pixels on the same line in image data. Note that the scanning line refers to a path of a light beam on a photosensitive member. The line refers to a group of pixels having the same position in the sub-scanning direction in image data.

The lower portion of FIG. 9 shows a relationship between five adjacent scanning line paths and pixels when curvature correction has been performed. In curvature correction, data replacement (replacement of a scanning line) is performed so that data of a pixel of interest is drawn using another scanning line adjacent to an original scanning line at a plurality of appropriate positions (replacement points) in the main scanning direction. A portion of pixels in a pixel sequence forming a first scanning line of a first color is replaced by a different portion of pixels in a pixel sequence forming a second scanning line of the first color where the different portion of pixels are adjacent to the portion of pixels. For example, the amount of correction is zero in sections B and D. The data of pixels are shifted downward by one pixel in sections A and E. The data of pixels is shifted upward by one pixel in section C. Thereby, a line of interest that is a set of shaded circles is substantially straight in the formed image.

If simple curvature correction is only applied, a bump of one pixel occurs. Therefore, in order to cause this bump to be difficult to see, a gray level calculation is performed with respect to the density data of a pixel of interest existing near a bump (replacement point) and the density data of a pixel adjacent thereto in the sub-scanning direction. This is called a blend process.

Figure 10:
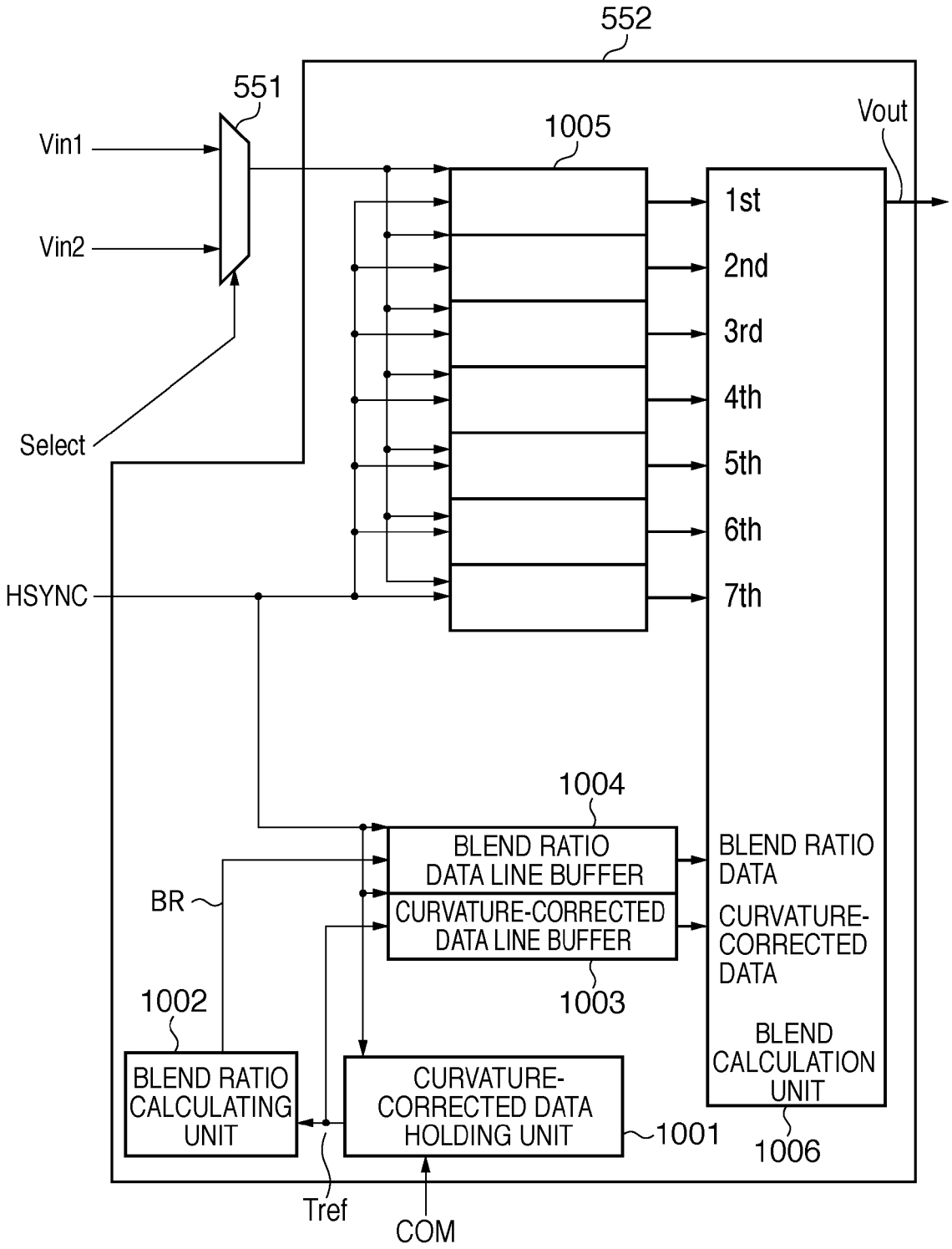
FIG. 10 is an illustrative block diagram of a curvature correcting process unit according to an embodiment of the present invention.

FIG. 10 is an illustrative block diagram of the curvature correcting process unit of the embodiment. As described above, the curvature correcting process unit 552 is provided in the image processing unit 407.

A video input signal supplied from the gamma correction unit 406, which is image data corresponding to a laser emission pattern, is indicated by "Vin1". Vin1 is implemented by a 4-bit signal line bundle. A video input signal supplied from the pattern generator 430, which is image data corresponding to a laser emission pattern, is indicated by "Vin2". Vin2 is also implemented by a 4-bit signal line bundle. A main scanning synchronizing signal is indicated by "HSYNC". HSYNC is output from the CPU 301 at a timing when the BD signal is output from the main scanning write position sensor 503. HSYNC is used as timing with which image data is obtained from the gamma correction unit 406 or the pattern generator 430. HSYNC is distributed to each part so as to achieve operational synchronization. A selection signal for selecting a video input signal to be output from a plurality of received video input signals, which is supplied from the CPU 301, is indicated by "select".

A curvature-corrected data holding unit 1001 holds curvature-corrected data transmitted by a communication signal COM from the CPU 301. The curvature-corrected data is, for example, a pair (data set pair) of distance data indicating the distance Lm from HSYNC (BD) and correction amount data indicating the amount of correction (e.g., one to seven lines). For example, the curvature-corrected data holding unit 1001 holds up to 32 pairs of curvature-corrected data.

A reference curvature correction timing signal supplied from the curvature-corrected data holding unit 1001 is indicated by "Tref". A blend ratio calculating unit 1002 calculates and outputs a blend ratio that is applied to each pixel to which the blend process is to be applied. A blend ratio data signal indicating the calculated blend ratio is indicated by "BR".

A curvature-corrected data line buffer 1003 is a buffer for holding a curvature correction timing signal corresponding to one scan. A blend ratio data line buffer 1004 is a buffer for holding blend ratio data corresponding to one scan. Image data line buffers 1005 are buffers for holding video input signals (image data) of seven lines output from the image data holding unit 551.

A blend calculation unit 1006 functions as a 7-to-1 selector for selecting a line to be taken out based on curvature-corrected data, from pieces of image data of seven lines of the image data line buffers 1005. The blend calculation unit 1006 also has a function of performing blend calculation with respect to data of a pixel currently scanned, with reference to data of an adjacent pixel in the sub-scanning direction. For example, the blend calculation unit 1006 functions as a weighting process unit for changing the density of a pixel of interest existing near a replacement point and the densities of one or more pixels adjacent to the pixel of interesting in the sub-scanning direction, by weighting them, depending on a distance from the pixel of interest. The blend calculation unit 1006 may also be configured to execute a weighting process with respect to a pixel of interest, and an adjacent pixel that causes a color deviation of a second color with respect to a first color, of one or more adjacent pixels. Image data after curvature correction that is output to the laser PWM unit 560, which is a 4-bit video data signal, is indicated by "Vout".

The curvature correcting process unit 552 is an image clock synchronizing circuit that operates in synchronization with an image clock and executes one step per image clock. A process of one line in the main scanning direction is started in accordance with HSYNC. HSYNC has a cycle of about 10,000 image clocks. When the next HSYNC is input, the next line is a target to be processed. Image data input as the video input signals Vin1 and Vin2 has a resolution of 600 dpi in both the main scanning direction and the sub-scanning direction. Image data of one pixel is represented by four bits. In other words, the image data is 16-level density data. This means that the emission time of the laser PWM unit 560 has 16 levels.

<Generation of Blend Data>

Before an image forming operation, the CPU 301 writes initial data via the communication signal COM into the curvature-corrected data holding unit 1001. The initial data is determined based on a result of measurement of a curvature state of a scanning line using a measuring jig including a two-dimensional CCD in an inspection step during manufacture of an optical write unit.

The number of line buffers included in the image data line buffers 1005 is determined, depending on estimation of an error in optical design. Specifically, the curvature correction amount is estimated to be seven lines or less based on estimation of an error in optical design. Image data input from Vin1 and Vin2 are written into the seven line buffers, sequentially from the first line buffer. Every time HSYNC occurs, a line buffer to which image data is to be written is switched to the next (lower) line buffer. When image data is finally written into the seventh line buffer, image data is written into the first line buffer again. Data in the first line buffer is overwritten.

Thus, cyclic writing is executed with respect to the image data line buffers 1005.

When receiving seven lines of image data corresponding to a tip margin, the blend calculation unit 1006 starts data shift (replacement of a scanning line) so as to achieve curvature correction. In an initial state in which curvature correction is not executed, the blend calculation unit 1006 selects a line buffer that stores the third line (neutral line) of the seven line buffers. An instruction indicating which line buffer is to be selected is included in Tref output from the curvature-corrected data holding unit 1001. In the initial state, the curvature correction timing signal Tref includes an instruction not to activate. The blend ratio data BR indicates that the blend ratio is zero. Note that the image data line buffers 1005 employ a cyclic writing scheme. Therefore, the line buffer storing the third line (neutral line) is not necessarily the third line buffer counted from the uppermost line buffer. The line buffer storing a neutral line is the third line buffer counted from a line buffer in which data of the latest line has been written.

Figure 11:
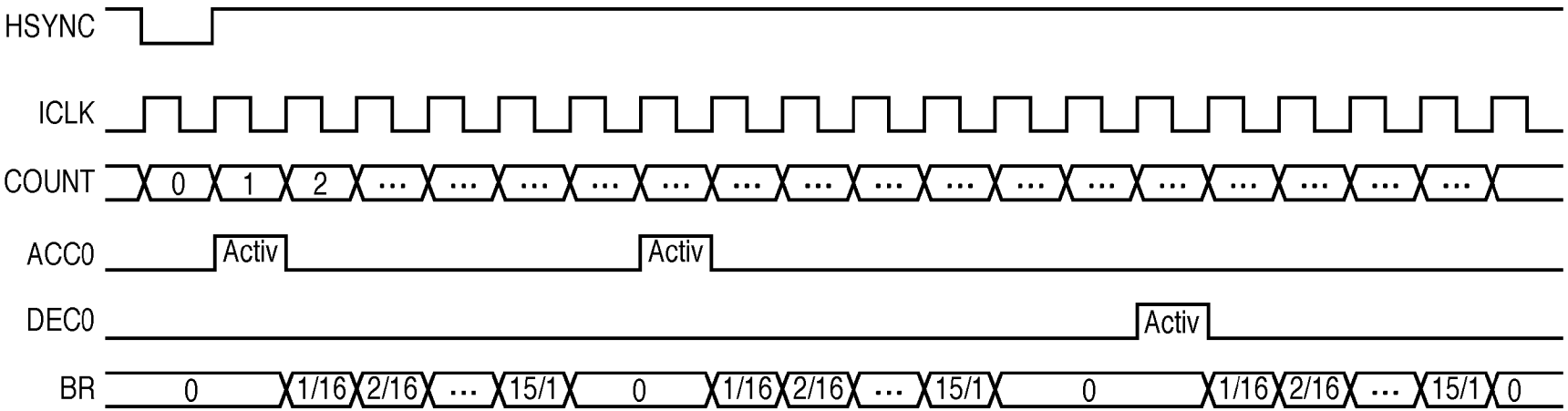
FIG. 11 is a timing chart showing a data flow in the curvature correcting process unit.

FIG. 11 is a timing chart showing a data flow in the curvature correcting process unit. A horizontal synchronizing signal is indicated by HSYNC. An image clock is indicated by ICLK. For the image clock, one horizontal rectangle corresponds to one clock time in FIG. 11. A count value of a counter for counting the position of a pixel in the main scanning direction in the curvature-corrected data holding unit 1001 is indicated by COUNT. The reference curvature correction timing signal Tref includes two signals ACC0 and DEC0. A signal indicating replacement to an upper line is indicated by ACC0. A signal indicating replacement to a lower line is indicated by DEC0. The blend ratio data is indicated by BR as described above.

The curvature-corrected data holding unit 1001 includes a counter for counting a current pixel position in the main scanning direction. The counter is initialized (cleared) when receiving HSYNC. When the received pixel distance data matches the count value of the counter, the curvature-corrected data holding unit 1001 activates the reference curvature correction timing signal Tref for one image clock. A movement direction (+1, −1) in the sub-scanning direction of the curvature-corrected data is indicated by ACC0 and DEC0 included in the reference curvature correction timing signal Tref. A position in the main scanning direction of the curvature-corrected data is represented by a timing at which a pulse is generated.

The blend ratio calculating unit 1002 calculates the blend ratio data BR so as to cause a bump to be difficult to see, in accordance with ACC0 and DEC0 of the received Tref. Further, the blend ratio calculating unit 1002 changes the blend ratio as the image clock advances. This is performed so as to weight the density, depending on a distance between a pixel of interest and an adjacent pixel. BR is transferred by four signals BLD3 to BLD0. Specifically, BLD3 to BLD0 indicate a blend ratio in the movement direction indicated by ACC0 and DEC0 and a position (timing) in the main scanning direction to which the blend is applied.

For example, it is assumed that the blend ratio is increased by 1/16 every image clock. Therefore, when eight image clocks have been input, the blend ratio is 8*(1/16)=50%. When fifteen image clocks have been input, the blend ratio is 15*(1/16)= about 94%. Note that when the final image clock has been input, the blend ratio returns to 0*(1/16)=0%, but is not 16*(1/16)= 100%.

Here, the curvature correction timing signal Tref is written into the curvature-corrected data line buffer 1003 in synchronization with the received image data (Vin1). Similarly, the blend ratio data BR is also written into the blend ratio data line buffer 1004 in synchronization with the received image data (Vin1).

<Blend Calculation>

Figure 12:
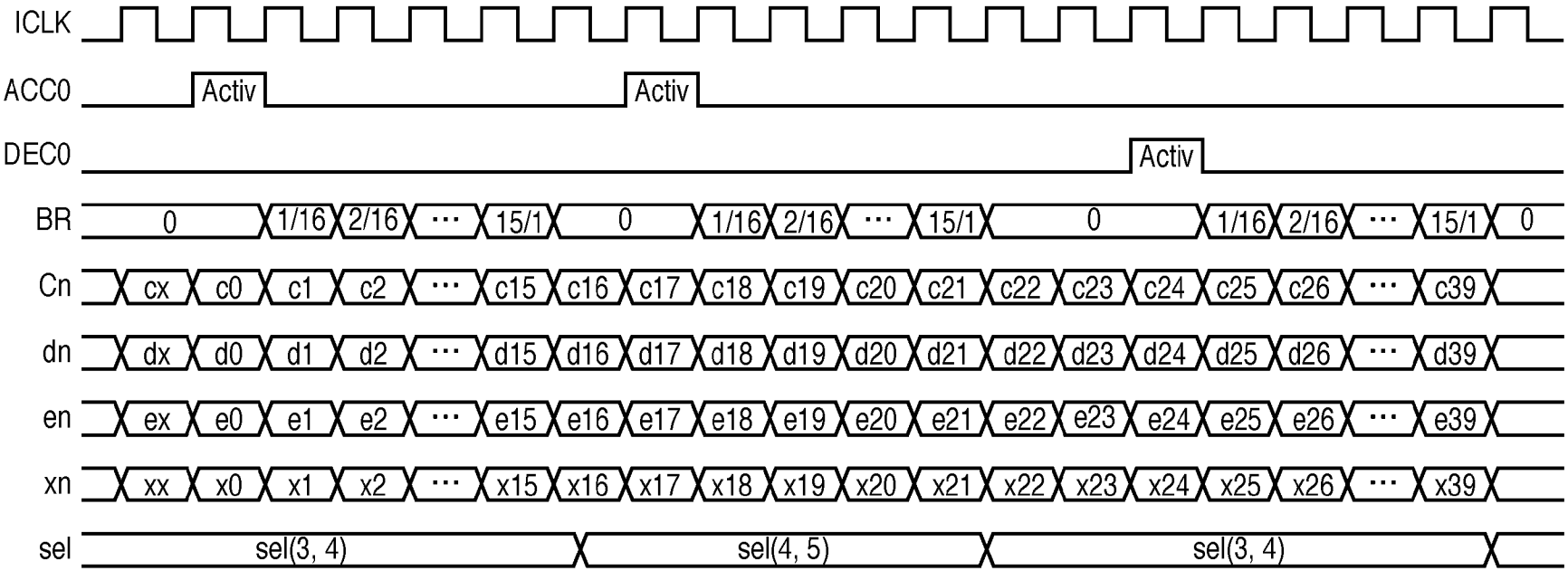
FIG. 12 is a diagram showing exemplary input/output data of a blend calculation unit.

FIG. 12 is a diagram showing exemplary input/output data of the blend calculation unit 1006. Data are read out from the curvature-corrected data line buffer 1003, the blend ratio data line buffer 1004 and the image data line buffers 1005 in synchronization with HSYNC.

A signal that is output from the third line buffer of the image data line buffers 1005 is indicated by "cn" (n is a suffix). A signal output from the fourth line buffer is indicated by "dn". A signal output from the fifth line buffer is indicated by "en". Data with respect to which curvature correction has been performed is indicated by "xn", which is Vout described above. A signal indicating which line buffer has been selected in the blend calculation unit 1006 is indicated by "Sel". For example, sel(3, 4) indicates that the third and fourth line buffers of the image data line buffers 1005 have been selected.

A shifter function (scanning line replacement function) of the blend calculation unit 1006 sets the third and fourth lines as lines to be read out from the image data line buffers 1005. Further, the blend calculation unit 1006 executes blend calculation with respect to pixel data of the read lines in accordance with the blend ratio data. Next, the blend calculation unit 1006 switches the lines to be read out to the fourth and fifth lines in accordance with the curvature-corrected data. At the same time when the line switching is performed, the blend ratio returns to 0%, so that shifting of one line is completed. In other words, holding of the third and fourth lines in the non-blended state is switched to holding of the fourth and fifth lines in the non-blended state.

As the output image data Vout, pixel data of the third line (non-blended state) is initially output. At the next clock, pixel data of the fourth line is weighted by 1/16 and pixel data of the third line is weighted by 15/16, and the sum data of these pieces of weighted pixel data is output as Vout. Further, at the next clock, pixel data of the fourth line is weighted by 2/16 and pixel data of the third line is weighted by 14/16, and the sum data of these pieces of the weighted data is output as Vout. Thereafter, every time the image clock advances by one clock, output data approaches data of the fourth line by 1/16 (i.e., goes away from data of the third line). For example, when eight image clocks have been input, 50% of pixel data from the third line and 50% of pixel data from the fourth line are summed and the resultant data is output as Vout. When fifteen image clocks have been input, 15/16 of output data is data from the fourth line and 1/16 thereof is data from the third line. Further, when the next image clock is input, only pixel data from the fourth line is output as Vout (non-blended state).

Vout is represented as follows.

xn=cn (n<2, 18≦n, except for the following blended portion)

$$xn=\{cn*(18-n)+dn*(n-2)\}/16(2\leqq n<18)$$

Pieces of data of a current drawn line of FIG. 12 are represented by "x3", "c3", "d3" and "e3". Here, "c" and "d" indicate pieces of image data that have the same position in the main scanning direction and are included in a line immediately before a current line and in the current line, respectively. "d" and "e" indicate pieces of image data that have the same position in the main scanning direction and are included in the current line and a line immediately after the current line, respectively. Numbers 1, 2, 3 and 4 in x3, c3, d3 and e3 indicate the locations on their lines in the main scanning direction.

x1, x2, x3 and x4 included in Vout are curvature-corrected image data of a current line drawn by laser. Here, a curvature correction position (replacement point) as a reference is a position where the blend ratio is 8/16.

The calculation process has been described above from a micro-level viewpoint. An example in which curvature correction is performed at a plurality of points will be described for easy understanding of the concept of the present invention.

<Result of Blend Process>

Figure 13:
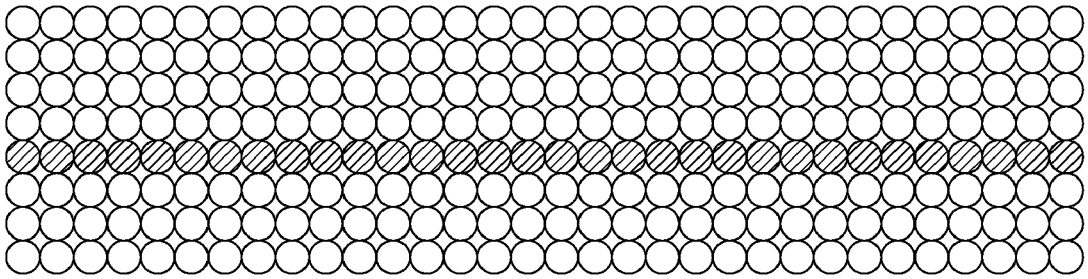
FIG. 13 is a diagram showing an original array of image data.
Figure 14:
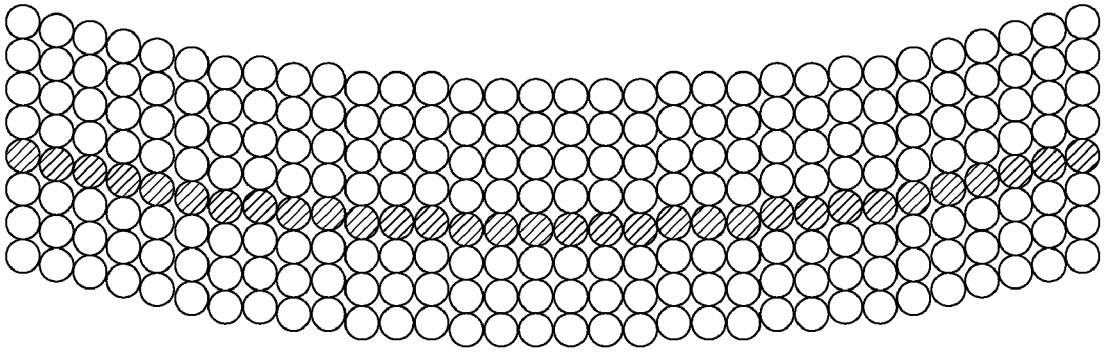
FIG. 14 is a diagram showing an example in which image formation is performed using the image data of FIG. 13 without curvature correction.

FIG. 13 is a diagram showing an original array of image data. A color (open or shading) corresponding to the density of each pixel is given to the pixel so as to easily understand the image data. FIG. 14 is a diagram showing an example in which image formation is performed using the image data of FIG. 13 without curvature correction. As can be seen from FIG. 14, a curvature appears in the sub-scanning direction.

Figure 15:
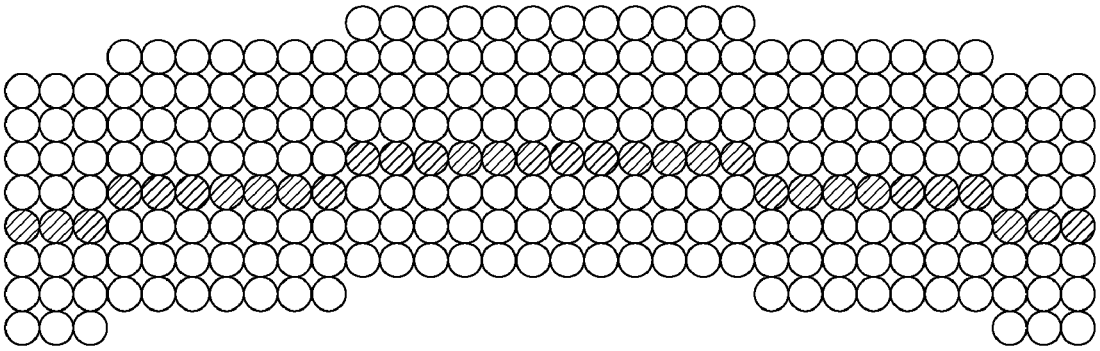
FIG. 15 is a diagram showing exemplary image data that is obtained by applying curvature correction to the image data of FIG. 13 and not applying a blend process thereto.
Figure 16:
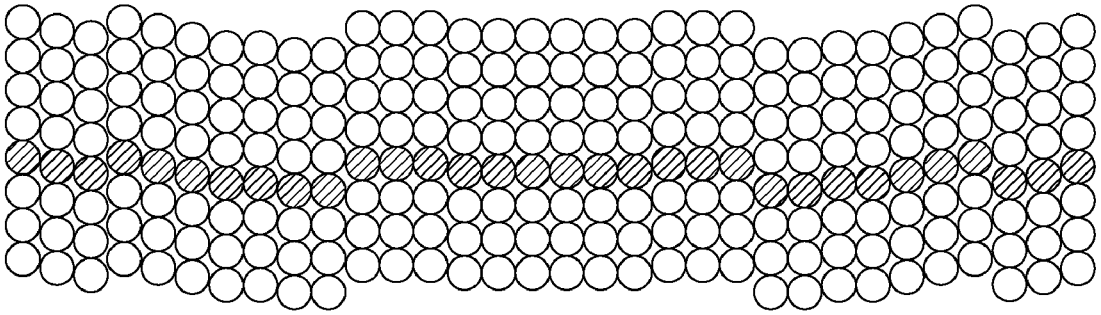
FIG. 16 is a diagram showing an exemplary image that is formed using the image data of FIG. 15.
Figure 17:
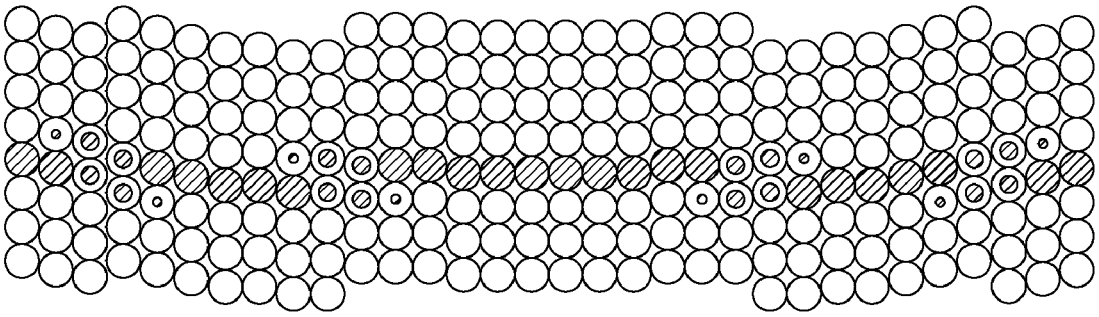
FIG. 17 is a diagram showing an exemplary image that is formed by further applying a blend process to the image data of FIG. 15.

FIG. 15 is a diagram showing exemplary image data that is obtained by applying curvature correction to the image data of FIG. 13 and not applying a blend process thereto. As can be seen from FIG. 15, a bump occurs near a replacement point. FIG. 16 is a diagram showing an exemplary image that is formed using the image data of FIG. 15. As shown in FIG. 16, a reduction in curvature can be visually recognized. Note that the corrected bump can be still noticeably visually recognized. FIG. 17 is a diagram showing an exemplary image that is formed by further applying the blend process to the image data of FIG. 15.

Thus, in this embodiment, the curvature correcting process of replacement a portion of pixels on a line of interest of image data to pixels an adjacent line is applied so as to correct a curvature of a scanning line of a first color. Moreover, in this embodiment, the blend process of adjusting the densities of a plurality of pixels existing near a pixel replacement point so as to reduce a bump occurring at the replacement point, is also applied. As a result, a corrected bump is caused to be difficult to see while reducing a curvature.

<Color Deviation Correction>

Hereinafter, a color deviation correcting process of changing data of a pixel near a replacement point so as to increase a width near the replacement point of a line of a second color that is formed and superimposed on a line of a first color, will be described. For example, a color deviation is reduced by enhancing the density of data of a pixel existing near a replacement point or enlarging a size (a spot diameter of a light beam) of the pixel. The image processing unit 407 described above is an exemplary enlargement process unit for enlarging the size of a pixel existing near a replacement point to a size larger than the normal size. The laser PWM unit 560 described above is an exemplary driving current control unit for increasing a driving current of a light source so as to enlarge the spot diameter of a light beam for forming a pixel.

Hereinafter, such color deviation correction is referred to as a "second-color supplementary blend process". Tref of the curvature correcting process and an output value of the blend ratio calculating unit 1002 differ between a first color and a second color.

For the second color, the reference curvature correction timing signal Tref includes two supplementary signals ACC2 and DEC2. Thereby, information about a position or a movement direction of a pixel to which a blend process for the first color is applied is transferred. A blend ratio is determined so that a thin blend process is performed with respect to the second color in accordance with the information about the first-color blend process.

<Supplementary Blend Data>

Figure 18:
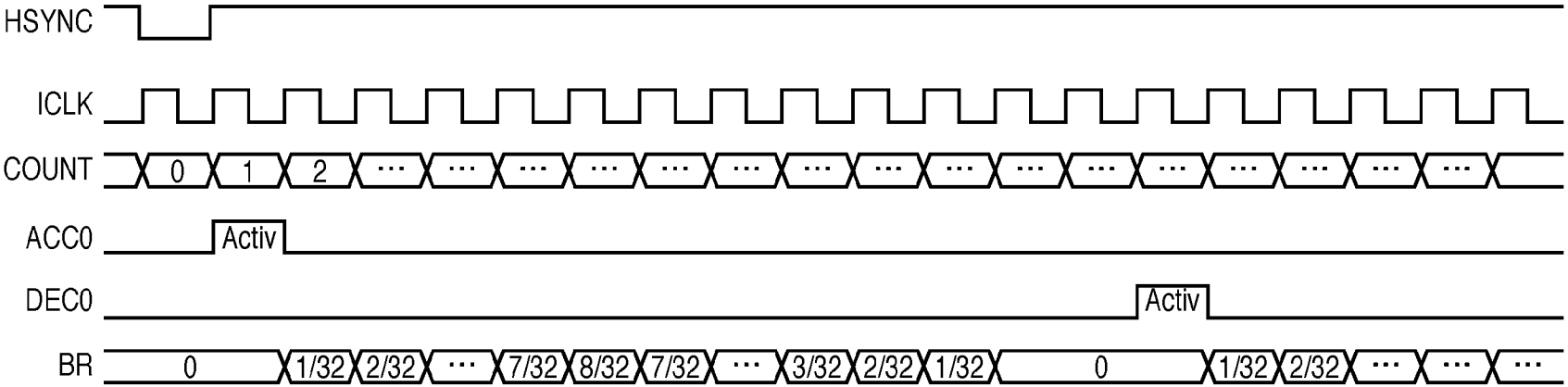
FIG. 18 is a timing chart showing a flow of supplementary blend data in the curvature correcting process unit.

FIG. 18 is a timing chart showing a flow of supplementary blend data in the curvature correcting process unit. Signals that have already been described are given the same names. An image clock is indicated by ICLK. For the image clock, one horizontal rectangle corresponds to one clock time of a clock synchronizing circuit. A count value of a counter for counting the position of a pixel in the main scanning direction in the curvature-corrected data holding unit 1001 is indicated by COUNT. The reference curvature correction timing signal Tref includes two signals ACC2 and DEC2. A signal indicating replacement to an upper line is indicated by ACC2. A signal indicating replacement to a lower line is indicated by DEC2. Blend ratio data is indicated by BR.

The blend ratio data BR differs between the first color and the second color. When receiving the reference curvature correction timing signal Tref, the blend ratio calculating unit 1002 generates the blend ratio data BR in accordance with Tref, and gradually changes the blend ratio as the image clock ICLK advances. BR is transferred by four signals BLD3 to BLD0. BLD3 to BLD0 indicate a blend ratio in a correction direction indicated by ACC2 and DEC2, and its blend timing. If it is here assumed that the blend ratio is inclined at a rate of an increase of 1/32 per image clock, e.g., the blend ratio is 8/32=25% after a lapse of eight image clocks. In supplementary blending, the blend ratio is switched to a downward direction from the time point of 25%. After a lapse of a total of 15 image clocks, the blend ratio is 1/32. After the next one clock, the blend ratio returns to 0/32=0%.

Here, the curvature correction timing signal Tref is written into the curvature-corrected data line buffer 1003 in synchronization with input image data, and the curvature correction blend ratio data BR is similarly written into the blend ratio data line buffer 1004.

<Supplementary Blend Calculation Process>

Figure 19:
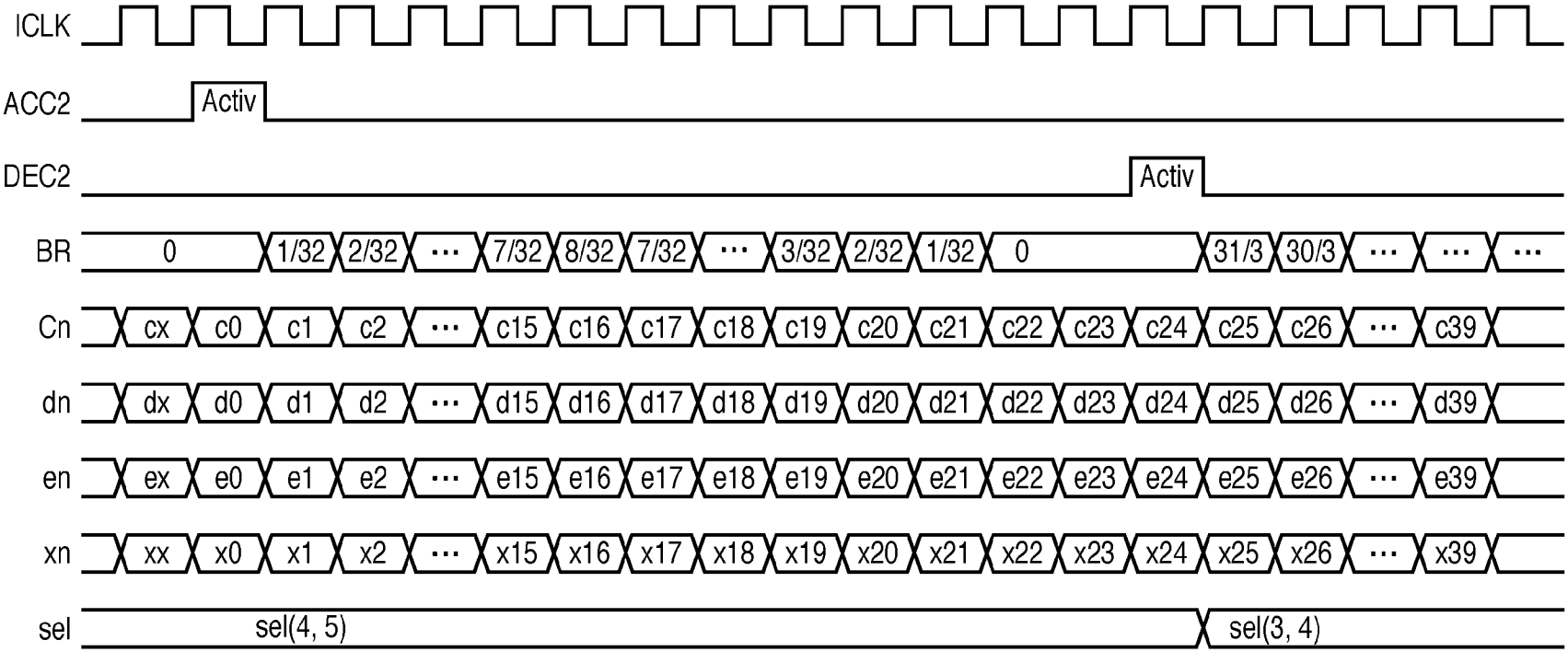
FIG. 19 is a timing chart showing exemplary input/output data at a blend calculation unit according to an embodiment.

FIG. 19 is a timing chart showing exemplary input/output data at the blend calculation unit 1006 of the embodiment. The name of each signal is the same as that which has already been described above. A selected line buffer differs between a first color and a second color. In other words, Sel in FIG. 19 differs. For example, changing of Sel depending on ACC2 does not occur at any time. On the other hand, changing of Sel occurs at the first position corresponding to DEC2. Specifically, sel(3, 4) before DEC2 is active is changed to sel(5, 4) after DEC2 is active. After supplementary blending is ended, Sel returns to original sel(3, 4).

The shifter function provided in the blend calculation unit 1006 maintains the third and fourth line buffers as line buffers to be read out of the image data line buffers 1005 between. The blend calculation unit 1006 executes blend calculation in accordance with data output from the third and fourth line buffers. In order to cause the blend ratio to finally return to 0%, supplementary blending of the second color is performed without shifting even one line, so that the non-blended state is maintained.

The output signal xn of image data is initially an output in the non-blended state from the third line buffer. At the next clock, xn is data 1/32 of which is data from the fourth line buffer and 15/32 of which is data from the third line buffer, i.e., xn is in a blended state. From the next clock, xn gradually approaches by 1/32 to the data from the fourth line buffer every clock. At the eighth clock, data from each of the third and fourth line buffers accounts for 25% of xn. Thereafter, at the fifteen clock, 1/16 of xn is data from the fourth line buffer and 15/16 of xn is data from the third line buffer. At the next clock, xn is made only of data from the third line buffer (non-blended state). The resultant xn thus bended is represented as follows.

xn=cn (n<2, 18≦n, except for the following blended portions)

$$xn=\{cn*(34-n)+dn*(n-2)\}/32(2\leqq n<10)$$

$$xn=\{cn*(14+n)+dn*(18-n)\}/32(10\leqq n<18)$$

<Effect of Second-Color Supplementary Blend Process>

Figure 20:
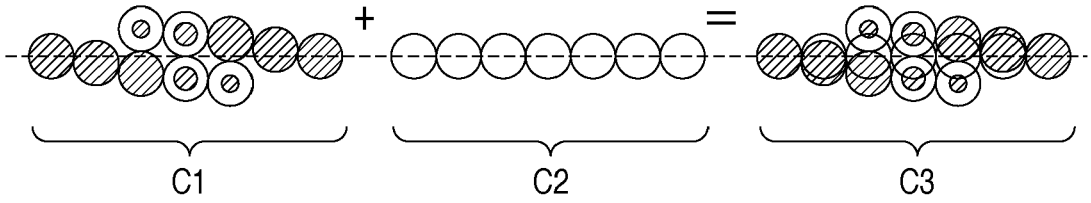
FIG. 20 is a diagram showing a comparative example in which a thin line is drawn in an intermediate color between a first color and a second color by simply superimposing a thin line (straight line) of the second color on a line of the first color.

FIG. 20 is a diagram showing a comparative example in which a thin line is drawn in an intermediate color between a first color and a second color by simply superimposing a thin line (straight line) of the second color on a line of the first color. The first term C1 on the left side indicates an image of the first color, in which curvature correction by replacement of a scanning line and the blend process are applied. A size of a circle indicates a density ratio of a pixel by a blend process. The second term C2 on the left side indicates an image of the second color. For the second color, since a scanning line curvature is small, pixels are arranged on a line. The term C3 on the right side indicates an image after superimposition.

The thin line of the first color and the thin line of the second color are controlled in accordance with a color deviation amount obtained using a patch so that the barycenters thereof substantially coincide with each other. However, although the line width of the thin line of the first color near a replacement point is two lines, the line width of the thin line of the second color is one line. Therefore, a maximum color deviation ratio is 2:1 for an image after superimposition, so that a color deviation is easily visually recognized.

Figure 21:
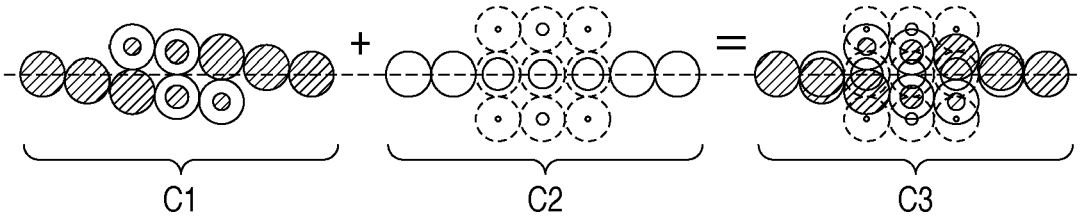
FIG. 21 is a diagram showing an example in which a thin line is drawn in an intermediate color between a first color and a second color by superimposing a thin line (straight line) of the second color to which a second-color supplementary blend process according to an embodiment has been applied, on a line of the first color.

FIG. 21 is a diagram showing an example in which a thin line is drawn in an intermediate color between a first color and a second color by superimposing a thin line (straight line) of the second color to which the second-color supplementary blend process of the embodiment has been applied, on a line of the first color. Since the thin line of the second color is enlarged to a width of three lines, a maximum color deviation ratio is 2:3. Thereby, a color deviation is caused to be relatively difficult to recognize.

In the comparative example, the color deviation amount is two lines−one line=one line. In the embodiment, the color deviation amount is also three lines−two lines=one line. That is, both cases have the same color deviation amount. However, of the three lines of the second color, the upper and lower lines have a pixel density that is controlled so that it is lower than the density of a pixel of the first color with respect to which the blend process has been performed. In other words, the size of a circle is reduced. Therefore, this embodiment causes a color deviation to be much more difficult to see than in the comparative example.

Second Embodiment

Supplementary Enhancement Process

In the first embodiment, a blend process of up to 25% is performed with respect to each of an upper line and a lower line for a second color by the second-color supplementary blend process. In a second embodiment, a second-color supplementary blend process is achieved by increasing the density of one pixel of a second color more than normal. The density may be increased by enlarging a spot diameter of a light beam formed on a photosensitive member. In order to enlarge the spot diameter, there are a method of increasing an exposure time and a method of increasing a driving current. Note that it is assumed in this embodiment that the spot diameter of a light beam that can be formed by the semiconductor laser device 501 has not reached its upper limit (i.e., the spot diameter can be enlarged). The second-color supplementary blend process of the second embodiment is hereinafter referred to as supplementary increase.

The second embodiment is different from the first embodiment in the operation of FIG. 18. Specifically, as BR, density increase ratio data is employed instead of the blend ratio data. Vout of the second embodiment is as follows.

xn=cn (n<2, 18≦n, except for the following blended portions)

$$xn=cn*\{32+(n-2)\}/32(2\leqq n<10)$$

$$xn=cn*\{32+(18-n)\}/32(10\leqq n<18)$$

Note that, in the second embodiment, line buffer selection is the same with respect to an operation for the second color of FIG. 19. In the second embodiment, for example, by setting an enhancement ratio to be 25%, a line width of a second color is the width of 1.25 lines at the maximum.

Figure 22:
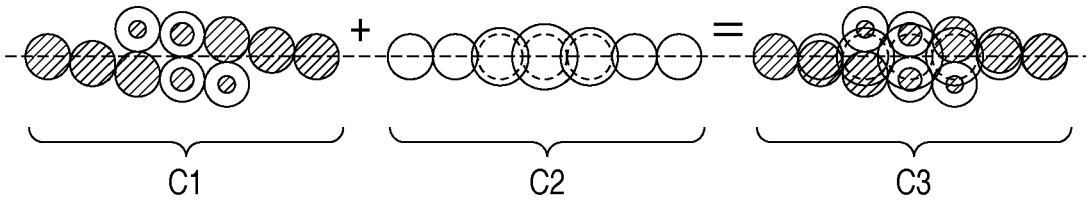
FIG. 22 is a diagram showing an example in which a thin line is drawn in an intermediate color between a first color and a second color by superimposing a thin line (straight line) of the second color to which a second-color supplementary blend process according to an embodiment has been applied, on a line of the first color.

FIG. 22 is a diagram showing an example in which a thin line is drawn in an intermediate color between a first color and a second color by superimposing a thin line (straight line) of the second color to which the second-color supplementary blend process of the embodiment has been applied, on a line of the first color. As can be seen from FIG. 22, a size of a pixel near a replacement point is enlarged (density is enhanced). The maximum color deviation ratio of an image after superimposition is 2:1.25. Therefore, it could be understood that a color deviation is reduced as compared to when the maximum color deviation ratio is 2:1 in the comparative example of FIG. 20.

Third Embodiment

Enhancement of Two Pixels in Color Deviation Direction

In the first embodiment, the supplementary blend process is executed by up to 25% in each of an upper line and a lower line for a center line of a second color. This is preferable when a scanning line of a first color and a scanning line of a second color are deviated from each other by 50% in the sub-scanning direction at a replacement position (blend position).

However, when a color deviation of 25% or 75% occurs in the sub-scanning direction at a blend position of the first color and the second color, a direction of supplementary blending for the second color is more preferably determined so that a bump caused by blending of the first color is compensated for.

Figure 23:
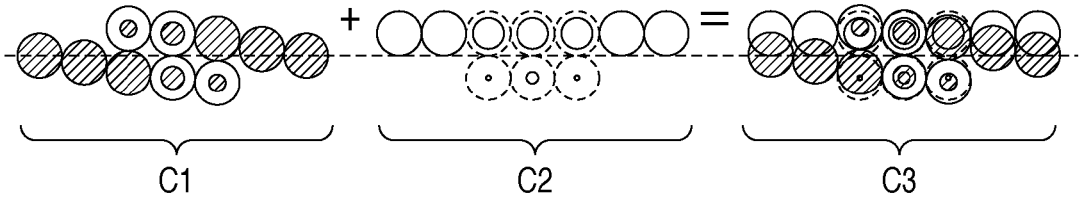
FIG. 23 is a diagram showing an example in which, when a color deviation amount is 25% in the sub-scanning direction, a thin line is drawn in an intermediate color between a first color and a second color by superimposing a thin line (straight line) of the second color to which a second-color supplementary blend process according to an embodiment has been applied, on a line of the first color.
Figure 24:
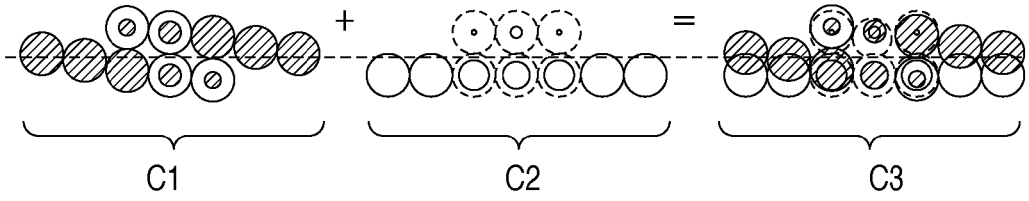
FIG. 24 is a diagram showing an example in which, when a color deviation amount is 75% in the sub-scanning direction, a thin line is drawn in an intermediate color between a first color and a second color by superimposing a thin line (straight line) of the second color to which a second-color supplementary blend process according to an embodiment has been applied, on a line of the first color.

FIG. 23 is a diagram showing an example in which, when a color deviation amount is 25% in the sub-scanning direction, a thin line is drawn in an intermediate color between a first color and a second color by superimposing a thin line (straight line) of the second color to which the second-color supplementary blend process of the embodiment has been applied, on a line of the first color. FIG. 24 is a diagram showing an example in which, when a color deviation amount is 75% in the sub-scanning direction, a thin line is drawn in an intermediate color between a first color and a second color by superimposing a thin line (straight line) of the second color to which the second-color supplementary blend process of the embodiment has been applied, on a line of the first color. It can be found that, in either case, the maximum color deviation ratio is 2:2, so that a color deviation is reduced.

Other Embodiments

Blend Process for Three (Upper, Middle and Lower) Pixels or Two (Upper and Lower) Pixels Although it has been mainly assumed in the embodiments above that a color deviation amount in an initial state is 50%, the present invention is not limited to such a particular numerical value. For example, a plurality of alternative methods may be employed as described below.

For example, as the second-color supplementary blend process, any of the blend processes described in the first to third embodiments may be applied to three (upper, middle and lower) pixels in the sub-scanning direction without depending on a color deviation state after adjustment (direction, amount). Also, as the second-color supplementary blend process, any of the blend processes described in the first to third embodiments may be applied to two pixels or one middle pixel of three (upper, middle and lower) pixels in the sub-scanning direction.

In particular, data to which supplementary enhancement has been applied is, for example, represented as follows.

xn=cn (n<2, 18≦n, except for the following blended portions)

$$xn=cn+\{dn*(n-2)\}/32(2\leqq n<10)$$

$$xn=cn+\{dn*(18-n)\}/32(10\leqq n<18)$$

Supplementary blending of the second color may be executed, depending on a state (a direction and an amount of blending) after completion of adjustment of a color deviation. Specifically, in supplementary blending of the second color, "supplementary blending" or "supplementary enhancement" may be applied to three (upper, middle and lower) pixels, or two pixels or the middle pixel of the three (upper, middle and lower) pixels.

Any one or more of the first to third embodiments may be applied, depending on a state (a direction and an amount of blending) after completion of adjustment of a color deviation and a state of each curvature-corrected point. In addition, supplementary blending or supplementary enhancement may be applied to three (upper, middle and lower) pixels, or two pixels or the middle pixel of the three (upper, middle and lower) pixels.

Although it has been assumed in the embodiments above that two adjacent pixels are subjected to supplementary blending, blending or enhancement may be executed to a plurality of pixels that are separated from each other by a distance corresponding to two pixels or more. The density enhancement is the same as or similar to a process of thickening thin line data, character data or the like. Supplementary blending or supplementary enhancement may be applied only to a character and thin line area, such as a thin line or character data area or the like. In this case, the character and thin line area may be an area that is specified by a recognition unit for recognizing the character and thin line area, or an area that is specified by analyzing printer data. A switching unit for switching activity of the replacement process unit, the reduction process unit and the changing unit from inactive/disable to active/enable, when the character and thin line area is thus recognized, may be provided. The switching unit may be activating unit for activating the replacement process unit, the reduction process unit and the changing unit. For example, the CPU 301 or the MFP control unit 305 may function as the recognition unit or the switching unit, or another processing circuit functioning as the recognition unit or the switching unit may be additionally provided.

Although it has been described that supplementary blending and supplementary enhancement are a process for a second color with respect to a blend process for a first color, a supplementary blend process for a second color may be applied to a first color to which a blend process has not been applied. Also, for a pixel to which a blend process for a second color has been applied, supplementary blending and supplementary enhancement may also be applied to a first color.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-303538, filed Nov. 22, 2007 which is hereby incorporated by reference herein in its entirety.

What is claimed is:

1. An image forming apparatus for forming a multi-color image by superimposing a first color and a second color, the image forming apparatus comprising:

a first process unit which shifts a portion of pixels in a pixel sequence forming a first scanning line of the first color to a pixel sequence forming a second scanning line of the first color, and which adjusts densities of a plurality of pixels existing near a shift point to reduce a bump occurring at the shift point, wherein the shift point refers to a boundary between a pixel that is shifted by the first process unit and a pixel that is not shifted by the first process unit; and a second process unit which performs a thicken process to a pixel sequence of a scanning line of the second color superimposed on the first scanning line of the first color to thicken the pixel sequence of the scanning line of the second color in a sub-scanning direction, wherein the pixel sequence of the scanning line of the second color to be thickened corresponds to the shifted pixels of the first color, wherein said second process unit includes a weighting process unit which changes a density of a pixel of interest existing near the shift point and a density of one or more pixels adjacent to the pixel of interest in the sub-scanning direction, by weighting the densities, depending on a distance from the pixel of interest.

2. The image forming apparatus according to claim 1, wherein said weighting process unit is adapted to execute a weighting process with respect to the pixel of interest, and an adjacent pixel which causes a color deviation of the second color with respect to the first color, of the one or more adjacent pixels.

3. The image forming apparatus according to claim 1, further comprising:

a recognition unit which recognizes a character and thin line area included in the image data; and a switching unit which switches activity of said first process unit and said second process unit from inactive to active, when the character and thin line area is recognized.

4. A method of forming a multi-color image by superimposing a first color and a second color, the method comprising:

a first process step for shifting a portion of pixels in a pixel sequence forming a first scanning line of the first color to a pixel sequence forming a second scanning line of the first color and for adjusting densities of a plurality of pixels existing near a shift point to reduce a bump occurring at the shift point, wherein the shift point refers to a boundary between a pixel that is shifted by the first process step and a pixel that is not shifted by the first process step; and a second process step for performing a thicken process to a pixel sequence of a scanning line of the second color superimposed on the first scanning line of the first color to thicken the pixel sequence of the scanning line of the second color in a sub-scanning direction, wherein the pixel sequence of the scanning line of the second color to be thickened corresponds to the shifted pixels of the first color, wherein said second process step includes a weighting process step for changing a density of a pixel of interest existing near the shift point and a density of one or more pixels adjacent to the pixel of interest in the sub-scanning direction, by weighting the densities, depending on a distance from the pixel of interest.

5. The method according to claim 4, wherein said weighting process step is adapted to execute a weighting process with respect to the pixel of interest, and an adjacent pixel which causes a color deviation of the second color with respect to the first color, of the one or more adjacent pixels.

6. The method according to claim 4, further comprising:

a recognition step for recognizing a character and thin line area included in the image data; and a switching step for switching activity of said first process step, said reduction process step, and said second process step from inactive to active, when the character and thin line area is recognized.

7. An image processing apparatus for forming a multi-color image by superimposing a first color and a second color, the apparatus comprising:

a first process unit which, based on a correction condition according to a bend of a scanning line in a first color, shifts first pixel data from the first scanning line in a first color to a second scanning line, and blends the shifted first pixel data and adjacent first pixel data being adjacent to the shifted first pixel data in a sub-scanning direction using a weighting process; and a second processing unit which blends pixel second data in the second color and adjacent pixel data being adjacent to the second pixel data in the sub-scanning direction using a weighting process based on the correction condition according to the bend of the scanning line in the first color, wherein said first process unit and said second process unit performs the weighting process, based on a weighting condition according to pixel position, on pixel data corresponding to a shift point of the scanning line in the first color and adjacent pixel data being adjacent in a main scanning line to the pixel data corresponding to the shift point.

* * * * *